US008477000B2

(12) United States Patent
Yuba et al.

(10) Patent No.: US 8,477,000 B2
(45) Date of Patent: Jul. 2, 2013

(54) RELAY

(75) Inventors: Takashi Yuba, Shinagawa (JP); Satoshi Takano, Shinagawa (JP); Hirofumi Saso, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/465,608

(22) Filed: May 7, 2012

(65) Prior Publication Data

US 2012/0223790 A1 Sep. 6, 2012

Related U.S. Application Data

(62) Division of application No. 12/155,135, filed on May 29, 2008, now Pat. No. 8,193,881.

(30) Foreign Application Priority Data

Sep. 14, 2007 (JP) ..... 2007-239233
Mar. 31, 2008 (JP) ..... 2008-089410

(51) Int. Cl.
*H01H 9/30* (2006.01)
*H01H 51/22* (2006.01)

(52) U.S. Cl.
USPC ..... 335/201; 335/78

(58) Field of Classification Search
USPC ..... 335/78–86, 124, 128–135, 201, 202
See application file for complete search history.

(56) References Cited

U.S. PATENT DOCUMENTS

| | | | | |
|---|---|---|---|---|
| 3,594,526 | A * | 7/1971 | Swindler | 218/23 |
| 4,367,448 | A | 1/1983 | Nishizako | |
| 4,404,443 | A * | 9/1983 | Coynel et al. | 218/23 |
| 4,509,025 | A * | 4/1985 | Kimpel et al. | 335/85 |
| 4,571,566 | A | 2/1986 | Saur | |
| 5,546,061 | A | 8/1996 | Okabayashi et al. | |
| 5,880,654 | A | 3/1999 | Yamaguchi et al. | |
| 5,889,454 | A * | 3/1999 | Hendel | 335/177 |
| 6,075,429 | A | 6/2000 | Uotome et al. | |

(Continued)

FOREIGN PATENT DOCUMENTS

| | | |
|---|---|---|
| GB | 979464 | 1/1965 |
| JP | 60-107551 | 7/1985 |

(Continued)

OTHER PUBLICATIONS

Patent Abstracts of Japan, Publication No. 2001-176370, Published Jun. 29, 2001.

(Continued)

*Primary Examiner* — Bernard Rojas
(74) *Attorney, Agent, or Firm* — Staas & Halsey LLP

(57) ABSTRACT

A relay is disclosed that includes a first opening and closing part including an openable and closable first gap; a second opening and closing part including an openable and closable second gap, the second opening and closing part being placed side by side with the first opening and closing part so that the first gap and the second gap are arranged side by side; a magnetization driving part configured to cause the first opening and closing part and the second opening and closing part to simultaneously operate; and a permanent magnet configured to apply a magnetic field on the first gap of the first opening and closing part and the second gap of the second opening and closing part in the same direction.

5 Claims, 24 Drawing Sheets

U.S. PATENT DOCUMENTS

| | | | | |
|---|---|---|---|---|
| 6,225,880 | B1 * | 5/2001 | Kern | 335/78 |
| 7,498,912 | B2 * | 3/2009 | Tsutsui et al. | 335/128 |
| 7,541,901 | B2 | 6/2009 | Nakano et al. | |
| 7,746,031 | B2 * | 6/2010 | Ishishita | 320/132 |
| 2001/0024108 | A1 * | 9/2001 | Tamura | 323/224 |
| 2008/0129249 | A1 | 6/2008 | Ishishita | |

FOREIGN PATENT DOCUMENTS

| | | |
|---|---|---|
| JP | 10-326553 | 12/1998 |
| JP | 2000-299046 | 10/2000 |
| JP | 2001-176370 | 6/2001 |
| KR | 10-0312465 | 11/2001 |

OTHER PUBLICATIONS

Patent Abstracts of Japan, Publication No. 10-326553, Published Dec. 8, 1998.

Patent Abstracts of Japan, Publication No. 2000-299046, Published Oct. 24, 2000.

European Search Report issued on Jan. 15, 2009 in corresponding European Patent Application No. 08157257.0.

Korean Office Action dated Apr. 28, 2010 in Korean Application No. 10-2008-0058404.

Office Action (Restriction Requirement) mailed Jun. 10, 2010 in co-pending U.S. Appl. No. 12/155,135.

Office Action mailed Jul. 22, 2010 in co-pending U.S. Appl. No. 12/155,135.

Final Office Action mailed Sep. 14, 2010 in co-pending U.S. Appl. No. 12/155,135.

Office Action mailed Jan. 21, 2011 in co-pending U.S. Appl. No. 12/155,135.

Final Office Action mailed Jun. 9, 2011 in co-pending U.S. Appl. No. 12/155,135.

Office Action (Advisory Action) mailed Sep. 30, 2011 in co-pending U.S. Appl. No. 12/155,135.

Office Action mailed Nov. 9, 2011 in co-pending U.S. Appl. No. 12/155,135.

Notice of Allowance mailed Mar. 1, 2012 in co-pending U.S. Appl. No. 12/155,135.

U.S. Appl. No. 12/155,135, filed May 29, 2008, Takashi Yuba, Fujitsu Component Limited.

* cited by examiner 10H
110H
111H
30H
(40H)
256X2
261
252X2
251X2
255X2
103HX2
104HX2
102HX2
100HX2
105HX2
250X2
120H
62H
Y1
Y2
Z1
Z2
X1
X2
11HX2
11HX1
250X1
113H
253X1
251X1
40H
112H
253X2
100HX1
64H
63H
115H
61H
LOAD
NEGATIVE TERMINAL OF POWER SUPPLY
POSITIVE TERMINAL OF POWER SUPPLY
121H

RELAY

CROSS-REFERENCE TO RELATED APPLICATIONS

This is a divisional application filed under 35 U.S.C. §120, of U.S. application Ser. No. 12/155,135, filed May 29, 2008, now U.S. Pat. No. 8,193,881, which is incorporated by reference in its entirety in this application, and which claims foreign priority benefit of Japanese Patent Application No. 2007-239233 filed on Sep. 14, 2007 and Japanese Patent Application No. 2008-089410 filed on Mar. 31, 2008, the entire disclosures of which are incorporated herein by reference.

BACKGROUND OF THE INVENTION

1. Field of the Invention

The present invention relates to relays, and more particularly to a direct current high voltage control relay employable in a circuit necessary, to interrupt a high-voltage direct current.

2. Description of the Related Art

A high-voltage direct current flows through some circuits such as a circuit near the battery of an electric car and the circuit of an uninterruptible power supply (UPS) that is activated to supply power to a computer system in the case of an outage of commercial power to the computer system.

In the case of applying a relay to such circuits, when the paired contacts of the relay in contact with each other are separated from each other, an arc current flows between the contacts because of the action of a high voltage on the relay, and this arc current damages the contacts so as to reduce the useful service life of the relay.

A unit that opens and closes the high-voltage direct-current circuit of the UPS includes a combination of a relay and a semiconductor switch. The semiconductor switch reduces the value of a current flowing through the relay so as to prevent an arc from being generated between the contacts of the relay at the time of opening the circuit.

However, according to this configuration, the semiconductor switch is required in addition to the relay so as to increase the number of components. This is a problem in terms of reliability and also increases cost.

Japanese Laid-Open Patent Application No. 2001-176370 shows a relay to be applied to a circuit near the battery of an electric car. According to this relay, a permanent magnet is provided near contacts so as to deflect an arc current generated at the time of separation of the contacts using the magnetic force of the permanent magnet, thereby preventing the contacts from being damaged and increasing the durability of the relay. Further, according to this relay, a pair of contact sets are arranged side by side, and the arc current generated between one of the contact sets and the arc current generated between the other one of the contact sets are deflected outward so as to be away from each other.

This relay, however, is provided in the middle of a circuit interconnection that connects one electrode, for example, the positive terminal of a direct-current power supply and a load circuit, and the above-described paired contact sets are connected in parallel in the circuit interconnection.

Therefore, even when the two contact pairs of the relay are open, the negative terminal of the direct-current power supply and the load circuit remain connected, so that the direct-current power supply and the load circuit are not completely independent of each other. As a result, there is the risk of continuously supplying current to the load circuit particularly when the ground potential is unstable.

Further, the above-mentioned relay is a terminal connection type and is large in size. Further, the above-mentioned relay is not so configured as to be mountable on a printed circuit board.

Japanese Laid-Open Patent Application No. 10-326553 shows a relay having a pair of contact sets and a permanent magnet provided between the paired contact sets and configured to be mountable on a printed circuit board. However, the arc generated at each contact set is not blown off outward, nor are the circuit interconnections extending from the positive terminal and negative terminal, respectively, of a direct-current power supply simultaneously broken.

SUMMARY OF THE INVENTION

Embodiments of the present invention may solve or reduce one or more of the above-described problems.

According to one embodiment of the present invention, there is provided a relay in which one or more of the above-described problems may be solved or reduced.

According to one embodiment of the present invention, there is provided a relay including a first opening and closing part including an openable and closable first gap; a second opening and closing part including an openable and closable second gap, the second opening and closing part being placed side by side with the first opening and closing part so that the first gap and the second gap are arranged side by side; a magnetization driving part configured to cause the first opening and closing part and the second opening and closing part to simultaneously operate; and a permanent magnet configured to apply a magnetic field on the first gap of the first opening and closing part and the second gap of the second opening and closing part in a same direction.

According to one embodiment of the present invention, there is provided a relay including a first relay main body including a first opening and closing part and a first magnetization driving part configured to cause the first opening and closing part to operate, the first opening and closing part including a first movable contact and a first fixed contact facing each other across a first gap so as to be movable into and out of contact with each other, a first movable spring terminal having the first movable contact, and a first fixed spring terminal having the first fixed contact; a second relay main body including a second opening and closing part and a second magnetization driving part configured to cause the second opening and closing part to operate, the second opening and closing part including a second movable contact and a second fixed contact facing each other across a second gap so as to be movable into and out of contact with each other, a second movable spring terminal having the second movable contact, and a second fixed spring terminal having the second fixed contact; a case including a side plate part and a top plate part and covering the first relay main body and the second relay main body; and a first permanent magnet and a second permanent magnet fixed to the top plate part of the case so as to face the first gap and the second gap, respectively, the first permanent magnet and the second permanent magnet being oriented so as to have a same magnetic pole facing toward the first and second gaps.

According to one embodiment of the present invention, there is provided a relay including a first relay main body including a first opening and closing part and a first magnetization driving part configured to cause the first opening and closing part to operate, the first opening and closing part including a first movable contact and a first fixed contact facing each other across a first gap so as to be movable into and out of contact with each other, a second movable contact and a second fixed contact facing each other across a second gap so as to be movable into and out of contact with each other, a first fixed spring terminal having the first fixed contact, a second fixed spring terminal having the second fixed contact, and a first movable spring member having the first movable contact and the second movable contact, the first movable spring member extending over the first fixed spring terminal and the second fixed spring terminal; a second relay main body including a second opening and closing part and a second magnetization driving part configured to cause the second opening and closing part to operate, the second opening and closing part including a third movable contact and a third fixed contact facing each other across a third gap so as to be movable into and out of contact with each other, a fourth movable contact and a fourth fixed contact facing each other across a fourth gap so as to be movable into and out of contact with each other, a third fixed spring terminal having the third fixed contact, a fourth fixed spring terminal having the fourth fixed contact, and a second movable spring member having the third movable contact and the fourth movable contact, the second movable spring member extending over the third fixed spring terminal and the fourth fixed spring terminal; a case including a side plate part and a top plate part and covering the first relay main body and the second relay main body; and a first permanent magnet and a second permanent magnet fixed to the top plate part of the case so that the first permanent magnet faces the first and second gaps and the second permanent magnet faces the third and fourth gaps, the first permanent magnet and the second permanent magnet being oriented so as to have a same magnetic pole facing toward the first through fourth gaps.

According to one embodiment of the present invention, there is provided a relay including a first opening and closing part including a first movable contact and a first fixed contact facing each other across a first gap so as to be movable into and out of contact with each other, a second movable contact and a second fixed contact facing each other across a second gap so as to be movable into and out of contact with each other, a first fixed spring terminal having the first fixed contact, a second fixed spring terminal having the second fixed contact, and a first movable spring member having the first movable contact and the second movable contact, the first movable spring member extending over the first fixed spring terminal and the second fixed spring terminal; a second opening and closing part including a third movable contact and a third fixed contact facing each other across a third gap so as to be movable into and out of contact with each other, a fourth movable contact and a fourth fixed contact facing each other across a fourth gap so as to be movable into and out of contact with each other, a third fixed spring terminal having the third fixed contact, a fourth fixed spring terminal having the fourth fixed contact, and a second movable spring member having the third movable contact and the fourth movable contact, the second movable spring member extending over the third fixed spring terminal and the fourth fixed spring terminal; a single magnetization driving part configured to cause the first opening and closing part and the second opening and closing part to operate; a case including a side plate part and a top plate part and covering the first opening and closing part, the second opening and closing part, and the magnetization driving part; and a first permanent magnet and a second permanent magnet fixed to the top plate part of the case so that the first permanent magnet faces the first and second gaps and the second permanent magnet faces the third and fourth gaps, the first permanent magnet and the second permanent magnet being oriented so as to have a same magnetic pole facing toward the first through fourth gaps.

According to one aspect of the present invention, a permanent magnet is provided so as to apply magnetic fields of the same orientation on the gap of a first opening and closing part (first gap) and the gap of a second opening and closing part (second gap). Therefore, it is possible to simultaneously break both a first circuit interconnection connecting the positive terminal of a direct-current power supply and a load and a second circuit interconnection connecting the negative terminal of the direct-current power supply and the load with a single relay by providing the first opening and closing part in the middle of the first circuit interconnection and providing the second opening and closing part in the middle of the second circuit interconnection.

Further, since the arcs generated in the first gap and the second gap are both blown off outward and extinguished, it is possible to prevent the first opening and closing part and the second opening and closing part from being damaged. As a result, there is no degradation of the performance of the relay even after multiple opening and closing operations, so that the relay enjoys a long useful service life.

Further, there is no need to cross circuit interconnections formed on a printed circuit board on which the relay is mounted. Accordingly, it is possible to form circuit connections using only one side of the printed circuit board.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of embodiments of the present invention.

[Principle of Direct Current High Voltage Control Relay]

First, a description is given of the principle of a direct current high voltage control relay according to the present invention.

Figure 1:
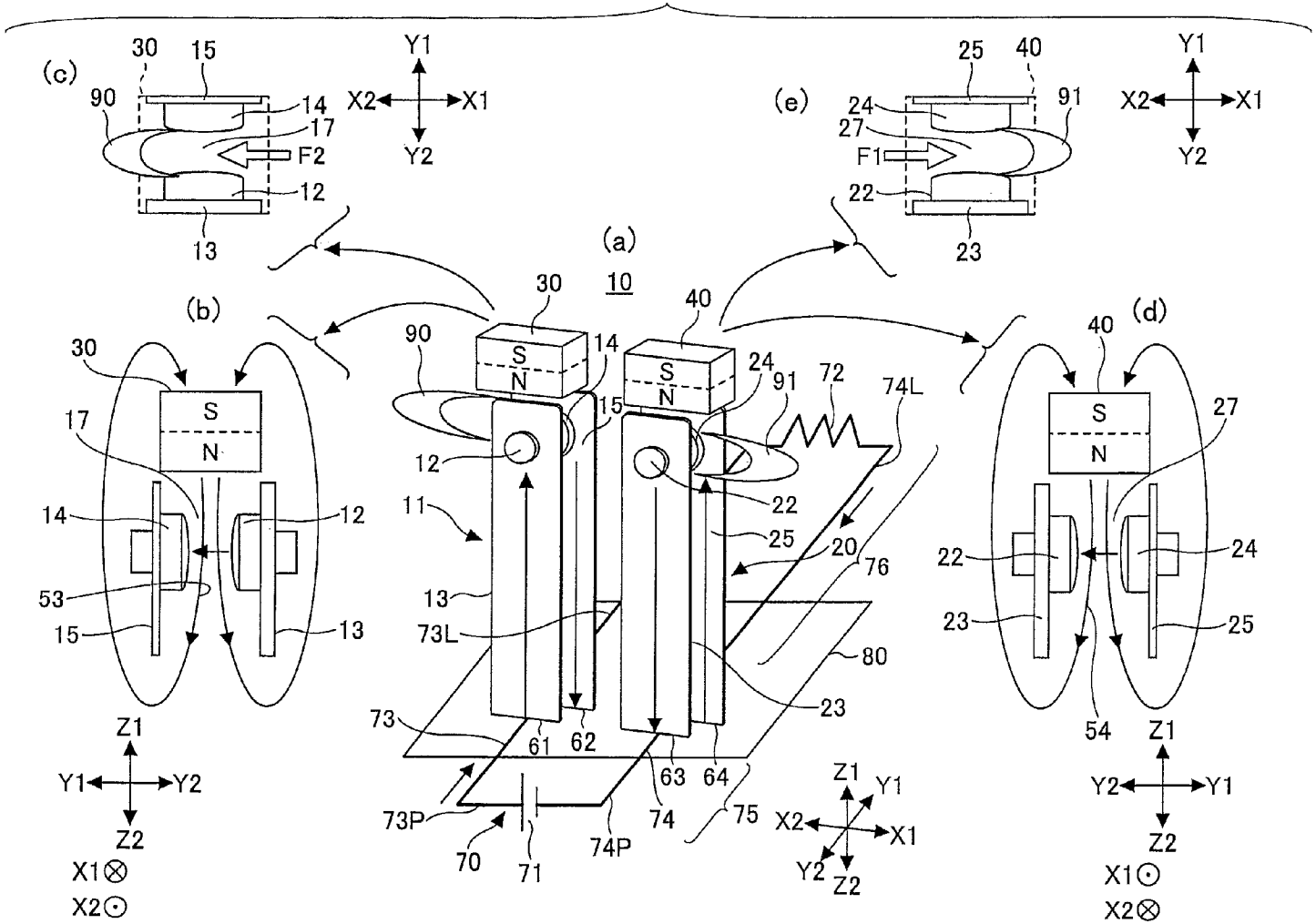
FIG. 1 is a schematic diagram showing a configuration of the principle of a relay according to the present invention.
Figure 2:
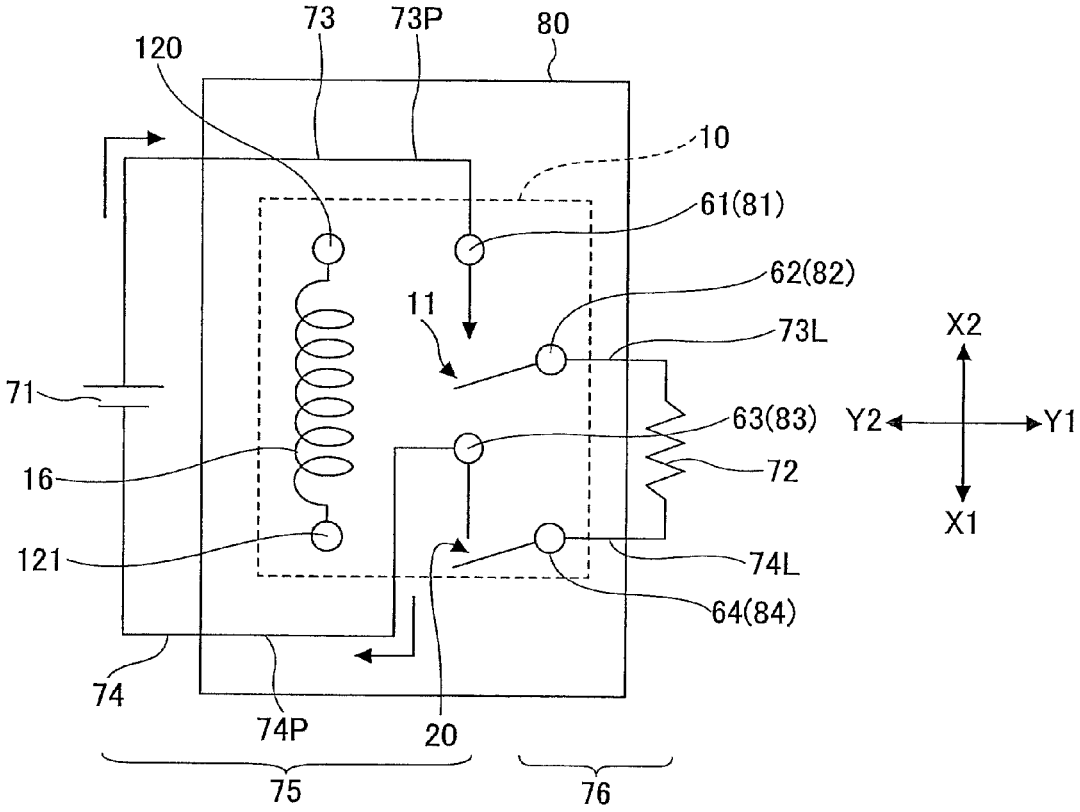
FIG. 2 is a schematic diagram showing an electric circuit device containing the relay according to the present invention.

FIG. 1 is a schematic diagram showing a configuration of the principle of the relay according to the present invention. FIG. 2 is a schematic diagram showing an electric circuit device containing the relay.

Referring to FIG. 1 and FIG. 2, a relay 10 includes a first opening and closing part 11 and a second opening and closing part 20 arranged side by side; a first permanent magnet piece 30 that acts on the first opening and closing part 11; and a second permanent magnet piece 40 that acts on the second opening and closing part 20.

In the drawings, X1-X2 indicates the directions in which the first opening and closing part 11 and the second opening and closing part 20 are arranged, Y1-Y2 indicates the directions in which the movable and fixed contacts of each of the first and second opening and closing parts 11 and 20 face each other, and Z1-Z2 indicates the lengthwise directions of the spring terminals of the first and second opening and closing parts 11 and 20.

The first opening and closing part 11 includes a first fixed spring terminal 13 having a first fixed contact 12 and a first movable spring terminal 15 having a first movable contact 14. There is a first gap 17 between the first fixed contact 12 and the first movable contact 14. The directions of the first gap 17 are the Y1-Y2 directions.

The second opening and closing part 20 includes a second fixed spring terminal 23 having a second fixed contact 22 and a second movable spring terminal 25 having a second movable contact 24. There is a second gap 27 between the second fixed contact 22 and the second movable contact 24. The directions of the second gap 27 are the Y1-Y2 directions.

A magnetizing coil 16 serving as a magnetization driving part is placed so as to face the first and second opening and closing parts 11 and 20. In FIG. 2, the magnetizing coil 16 is shown on the Y2 side of the opening and closing parts 11 and 20 for convenience of graphical representation. The same applies to FIG. 13 and FIG. 14.

Referring to (b) of FIG. 1, the first permanent magnet piece 30 serving as an arc suppressor or extinguisher, which is placed on the Z1 side of the first opening and closing part 11 with its north pole on the Z2 side and its south pole on the Z1 side, is strong so as to keep on applying a strong magnetic field 53 in the Z2 direction on the first gap 17.

Referring to (d) of FIG. 1, the second permanent magnet piece 40 serving as an arc suppressor or extinguisher, which is placed on the Z1 side of the second opening and closing part 20 with its north pole on the Z2 side and its south pole on the Z1 side the same as the first permanent magnet piece 30, is strong so as to keep on applying a strong magnetic field 54 in the Z2 direction on the second gap 27.

The magnetic fields 53 and 54 are indicated by magnetic lines of force. The direction of the magnetic fields 53 and 54 (Z2 direction) in the first and second gaps 17 and 27 is perpendicular to the directions of the first and second gaps 17 and 27 (Y1-Y2 directions).

The relay 10 includes terminals 61, 62, 63, and 64 projecting from the bases of the spring terminals 13, 15, 23, and 25, respectively, in the Z2 direction and terminals 120 and 121 connected to the corresponding ends of the magnetizing coil 16 and projecting in the Z2 direction, so as to be mountable on a printed circuit board.

It is specified on the terminal 61 with a sign and/or characters or letters that the terminal 61 is to be connected to the positive terminal of a direct-current power supply. It is specified on the terminal 63 with a sign and/or characters or letters that the terminal 63 is to be connected to the negative terminal of the direct-current power supply. It is specified on the terminal 62 that the terminal 62 is to be connected to one end of a load circuit. Likewise, it is specified on the terminal 64 that the terminal 64 is to be connected to the other end of the load circuit.

An electric circuit 70 to which the relay 10 is applied includes a direct-current power supply 71 that outputs a voltage as high as several hundred volts, a load circuit 72, a first circuit interconnection 73 that connects the positive terminal of the direct-current power supply 71 and the load circuit 72, and a second circuit interconnection 74 that connects the negative terminal of the direct-current power supply 71 and the load circuit 72. The electric circuit 70 includes a circuit part 75 on the direct-current power supply 71 side and a circuit part 76 on the load circuit 72 side, in which current flows in the direction indicated by arrows in FIG. 1 and FIG. 2.

The first circuit interconnection 73 and the second circuit interconnection 74 are formed on one side of a printed circuit board 80 as patterns. Referring to FIG. 2, in the printed circuit board 80, two through holes 81 and 82 are formed in the middle of the first circuit interconnection 73 in an arrangement corresponding to the terminals 61 and 62 of the first opening and closing part 11, and two through holes 83 and 84 are formed in the middle of the second circuit interconnection 74 in an arrangement corresponding to the terminals 63 and 64 of the second opening and closing part 20.

The first circuit interconnection 73 includes a pattern 73P extending from the positive terminal of the direct-current power supply 71, and the second circuit interconnection 74 includes a pattern 74P extending from the negative terminal of the direct-current power supply 71. The first circuit interconnection 73 includes a pattern 73L extending from one end of the load circuit 72, and the second circuit interconnection 74 includes a pattern 74L extending from the other end of the load circuit 72. The through hole 81 is formed at the end of the pattern 73P, the through hole 83 is formed at the end of the pattern 74P, the through hole 82 is formed at the end of the pattern 73L, and the through hole 84 is formed at the end of the pattern 74L.

The terminals 61, 62, 63, and 64 are inserted into and soldered to the through holes 81, 82, 83, and 84, respectively, and the terminals 120 and 121 are inserted into and soldered to corresponding through holes formed in the printed circuit board 80, so that the relay 10 is mounted on the printed circuit board 80 and used.

When a direct current flows through the magnetizing coil 16 so that the magnetizing coil 16 is excited, the first movable contact 14 is in contact with the first fixed contact 12 and the second movable contact 24 is in contact with the second fixed contact 22, so that the relay 10 is closed. As a result, a current flows as indicated by arrows, so that the load circuit 72 is in operation.

When energization of the magnetizing coil 16 is stopped, the first movable contact 14 moves out of contact with the first fixed contact 12, and the second movable contact 24 moves out of contact with the second fixed contact 22. The moment the first movable contact 14 moves out of contact with the first fixed contact 12, an arc (arc current) is generated in the first gap 17, and likewise, the moment the second movable contact 24 moves out of contact with the second fixed contact 22, an arc (arc current) is generated in the second gap 27.

Here, the strong magnetic field 53 is applied on the first gap 17 by the first permanent magnet piece 30. Therefore, as shown in (c) of FIG. 1, a Lorentz force F2 in the X2 direction acts on the arc based on Fleming's left-hand rule, so that the arc is deflected and blown off in the X2 direction from the first gap 17 as indicated by reference numeral 90 so as to be immediately extinguished. Further, since the arc is blown off in the X2 direction from the first gap 17 and extinguished immediately, the first movable contact 14 and the first fixed contact 12 suffer no damage.

The strong magnetic field 54 is applied on the second gap 27 by the second permanent magnet piece 40. Therefore, as shown in (e) of FIG. 1, a Lorentz force F1 in the X1 direction acts on the arc based on Fleming's left-hand rule, so that the arc is deflected and blown off in the X1 direction from the second gap 27 as indicated by reference numeral 91 so as to be immediately extinguished. Further, since the arc is blown off in the X1 direction from the second gap 27 and extinguished immediately, the second movable contact 24 and the second fixed contact 22 suffer no damage.

When the first movable contact 14 moves out of contact with the first fixed contact 12 and the second movable contact 24 moves out of contact with the second fixed contact 22, the first circuit interconnection 73 and the second circuit interconnection 74 are simultaneously broken at the part of the relay 10, so that the circuit part 75 on the direct-current power supply 71 side and the circuit part 76 on the load circuit 72 side are separated to be completely independent of each other in the electric circuit 70. As a result, even if the ground potential is unstable, no current is supplied to the load circuit 72.

Further, since neither the movable contacts 14 and 24 nor the fixed contacts 12 and 22 suffer damage, there is no degradation of the performance of the relay 10 even after its multiple operations, so that the relay 10 enjoys a long useful service life.

Figure 3:
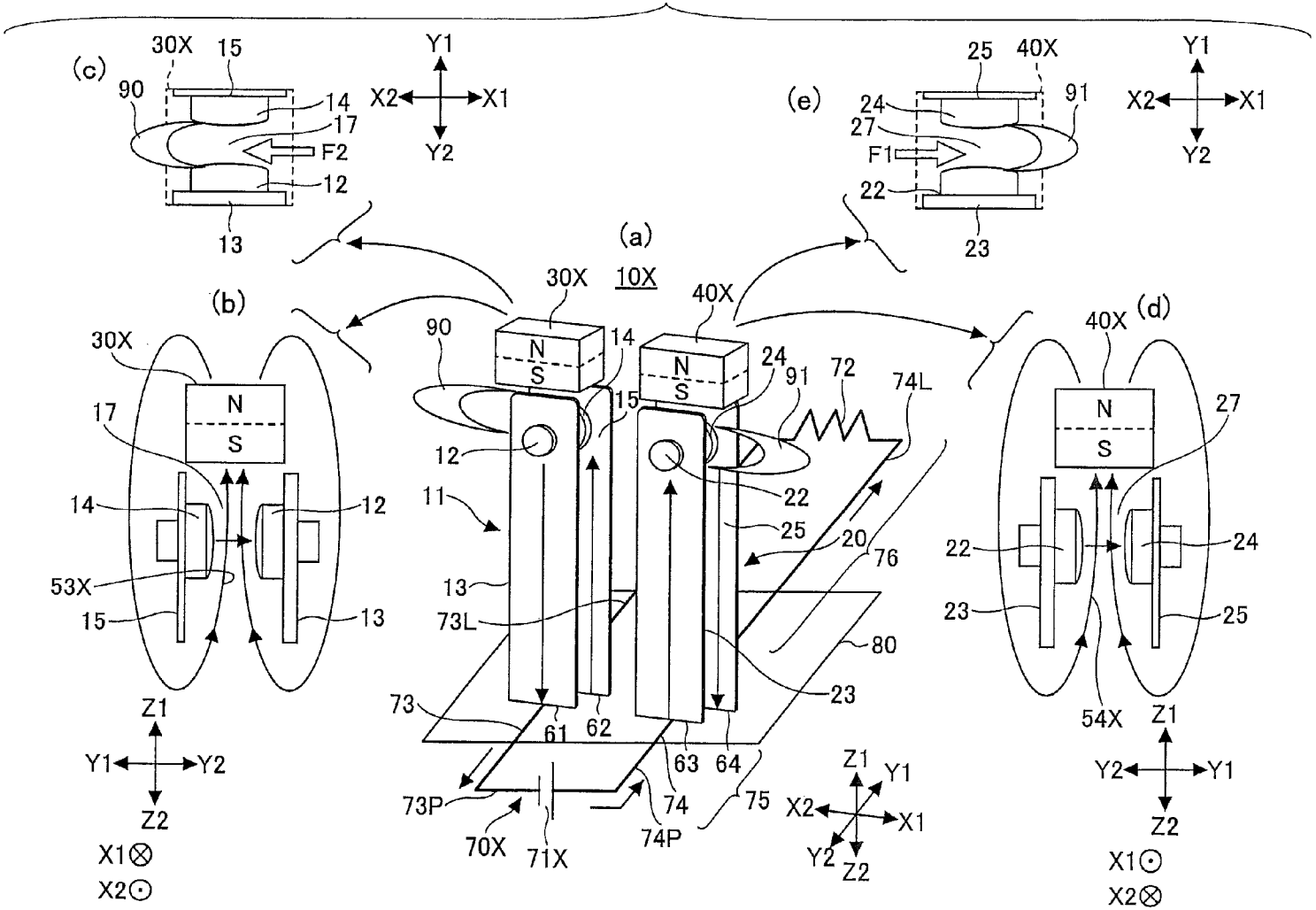
FIG. 3 is a schematic diagram showing another configuration of the principle of the relay according to the present invention.

FIG. 3 is a schematic diagram showing another configuration of the relay according to the present invention.

Referring to FIG. 3, a relay 10X is different from the relay 10 of FIG. 1 in that a first permanent magnet piece 30X and a second permanent magnet piece 40X are oriented so that their south poles are on the Z2 side and their north poles are on the Z1 side; it is specified on the terminal 61 that the terminal 61 is to be connected to the negative terminal of a power supply; and it is specified on the terminal 63 that the terminal 63 is to be connected to the positive terminal of the power supply. A magnetic field 53X and a magnetic field 54X, both in the Z1 direction, are applied on the first gap 17 and the second gap 27, respectively.

An electric circuit 70X to which the relay 10X of this configuration is applied is different from the electric circuit 70 of FIG. 1 in having a direct-current power supply 71X whose terminal orientation is reverse to that of the direct-current power supply 71 of FIG. 1.

When a direct current flows through the magnetizing coil 16 (FIG. 2) so that the magnetizing coil 16 is energized, the facing contacts 12 and 14 and the facing contacts 22 and 24 are in contact with each other so that the relay 10X is closed. As a result, a current flows as indicated by arrows in FIG. 3, so that the load circuit 72 is in operation.

When energization of the magnetizing coil 16 is stopped, the first movable contact 14 moves out of contact with the first fixed contact 12, and the second movable contact 24 moves out of contact with the second fixed contact 22. The moment the first movable contact 14 moves out of contact with the first fixed contact 12, an arc (arc current) is generated in the first gap 17, and likewise, the moment the second movable contact 24 moves out of contact with the second fixed contact 22, an arc (arc current) is generated in the second gap 27.

Here, the strong magnetic field 53X is applied on the first gap 17 by the first permanent magnet piece 30X. Therefore, as shown in (c) of FIG. 3, the Lorentz force F2 in the X2 direction acts on the arc based on Fleming's left-hand rule, so that the arc is deflected and blown off in the X2 direction from the first gap 17 as indicated by reference numeral 90 so as to be immediately extinguished.

The strong magnetic field 54X is applied on the second gap 27 by the second permanent magnet piece 40X. Therefore, as shown in (e) of FIG. 3, the Lorentz force F1 in the X1 direction acts on the arc based on Fleming's left-hand rule, so that the arc is deflected and blown off in the X1 direction from the second gap 27 as indicated by reference numeral 91 so as to be immediately extinguished.

First Embodiment

Figure 4:
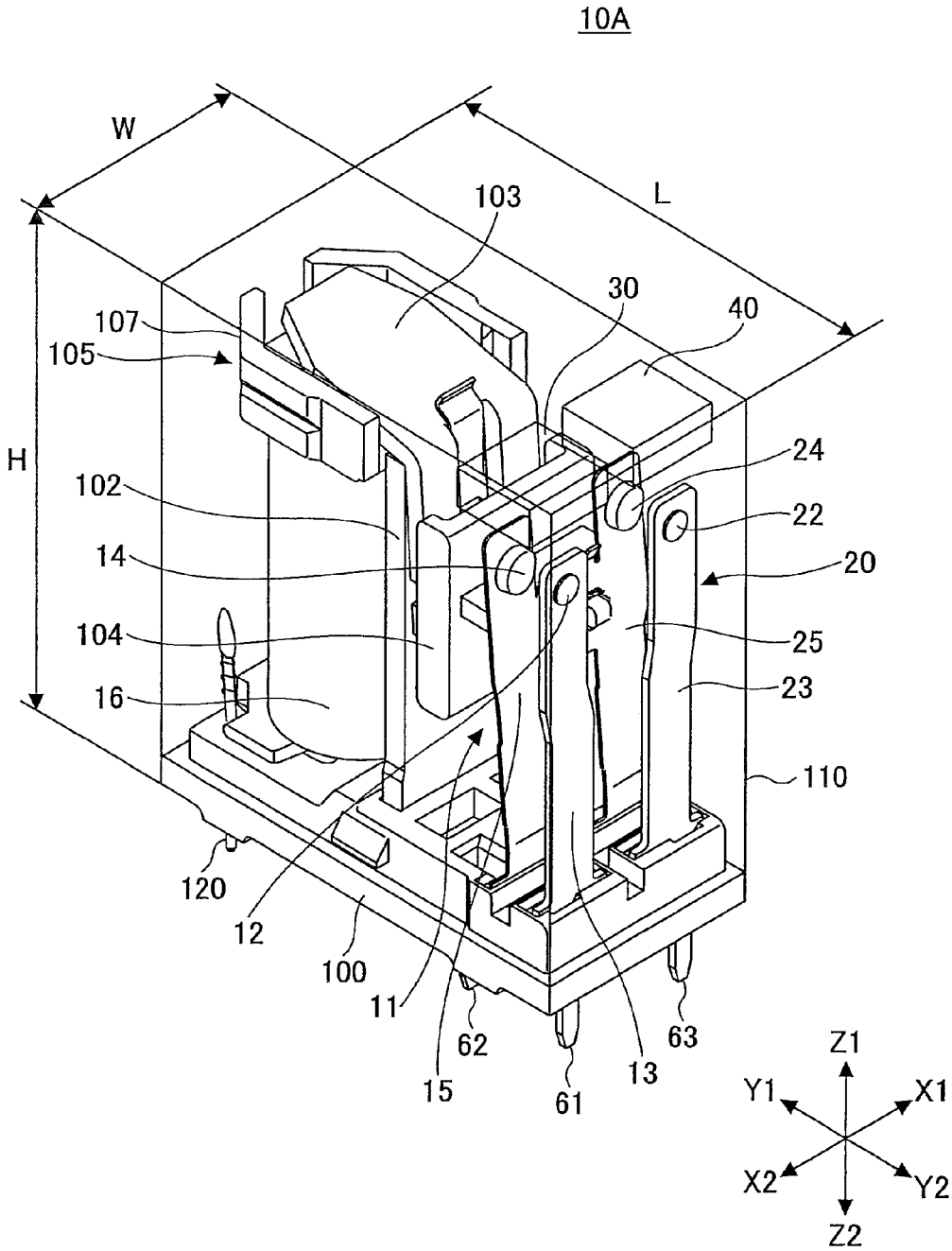
FIG. 4 is a perspective view of a relay, showing the relay through a case, according to a first embodiment of the present invention.

FIG. 4 is a perspective view of a small-size direct current high voltage control relay 10A according to a first embodiment of the present invention, showing the relay 10A through a case 110.

FIGS. 5A through 5D are a top (Z1-side) cut-away view, an X2-side cut-away view, a Y2-side cut-away view, and a bottom (Z2-side) plan view, respectively, of the relay 10A of FIG. 4. In the drawings, the elements corresponding to those of FIG. 1 are referred to by the same reference numerals, and a description thereof is omitted.

The relay 10A is an implementation of the relay 10 of the principle configuration shown in FIG. 1. The relay 10A has the first opening and closing part 11 and the second opening and closing part 20 placed on the X2 side and the X1 side, respectively, on a base 100 on its Y2 side; a yoke 102 provided in a vertical (standing) position in the center of the base 100; an armature 103 and a card 104 provided in the center of the base 100; and a magnetizing coil unit 105 mounted on and fixed to the base 100 on its Y1 side. The relay 10A is covered with the case 110 having a rectangular parallelepiped shape. Terminals are projecting from the bottom surface of the base 100 as described below. The relay 10A has a width W, a length L, and a height H. The magnetizing coil unit 105, the yoke 102, the armature 103, and the card 104 form a magnetization driving part. Each of the width W, the length L, and the height H is approximately 20 mm to 30 mm. The relay 10A is small in size, has terminals on the bottom surface (of the base 100), and may be mounted on the printed circuit board 80 and used.

The first opening and closing part 11 has the paired first fixed spring terminal 13 and first movable spring terminal 15 arranged to face each other in the Y1-Y2 directions. The second opening and closing part 20 has the paired second fixed spring terminal 23 and second movable spring terminal 25 arranged to face each other in the Y1-Y2 directions.

The magnetizing coil unit 105 has a former 107 and the magnetizing coil 16 wound around the former 107. The armature 103 has an L-letter shape and is supported by the yoke 102. The armature 103 has a horizontal part having an end thereof facing an electrode at the upper end of the magnetizing coil unit 105. The armature 103 has a vertical part to which the card 104, which is formed of insulating resin, is attached. The card 104 has its end on the other side attached to the central connection part of each of the movable spring terminals 15 and 25.

The case 110 is formed of a material highly resistant to heat, such as thermosetting resin (for example, an epoxy resin or phenolic resin).

The case 110 includes a top plate part 111. The first and second permanent magnet pieces 30 and 40 are formed on a Y2-side part of the interior surface of the top plate part 111 by insert molding. The first and second permanent magnet pieces 30 and 40 are arranged so as to be immediately over (on the Z1 side of) the first and second gaps 17 and 27, respectively, when the case 110 is attached to the base 100.

The first and second permanent magnet pieces 30 and 40 are samarium-cobalt magnets approximately 7 mm in length (in the X1-X2 directions), 5 mm in width (in the Y1-Y2 directions), and 2 mm to 3 mm in thickness (in the Z1-Z2 directions), and are strong. The first and second permanent magnet pieces 30 and 40 have the following properties:

Residual Flux Density Br: 1.07 to 1.15 Tesla;

Coercive Force $H_{CB}$: 597 to 756 kA/m;

Maximum Energy Product (BH)max: 199 to 247 kJ/m$^3$: and

Coercive Force $H_{CJ}$: 637 to 1432 kA/m.

Samarium-cobalt magnets have better heat resistance and are less likely to be demagnetized by heat than neodymium magnets. The first and second permanent magnet pieces 30 and 40 are oriented so as to have their south poles on the Z1 side and their north poles on the Z2 side.

The terminals 61, 62, 63, and 64 projecting from the bases of the spring terminals 13, 15, 23, and 25, respectively, are projecting from the bottom surface of the base 100 in the Z2 direction. Further, the terminals 120 and 121 connected to the corresponding ends of the magnetizing coil 16 are projecting from the bottom surface of the base 100 in the Z2 direction.

Figure 5A:
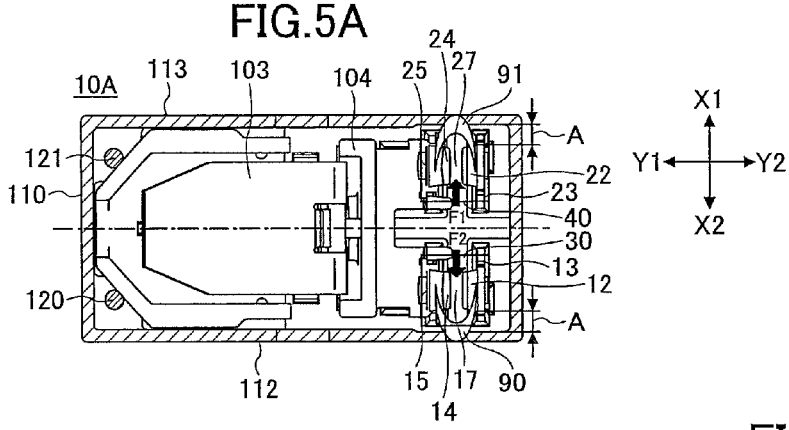
FIGS. 5A through 5D are a top cut-away view, an X2-side cut-away view, a Y2-side cut-away view, and a bottom plan view, respectively, of the relay of FIG. 4 according to the first embodiment of the present invention.
Figure 5B:
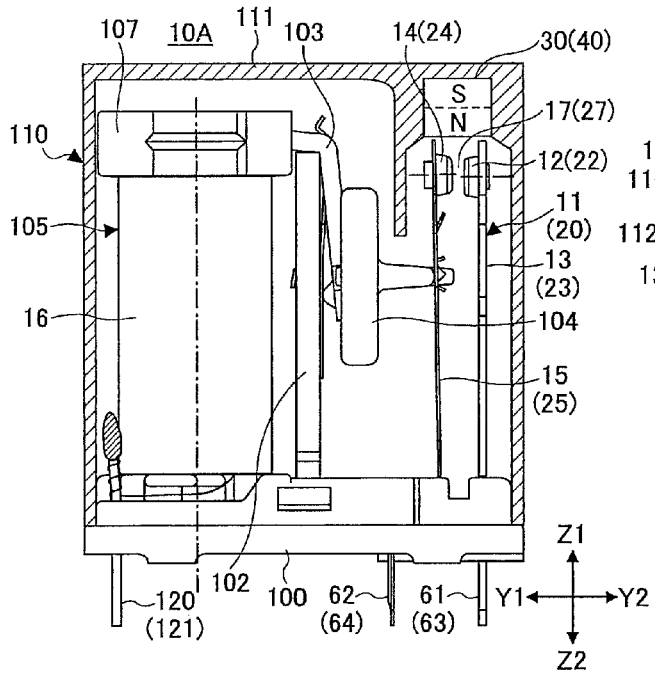
Figure 5C:
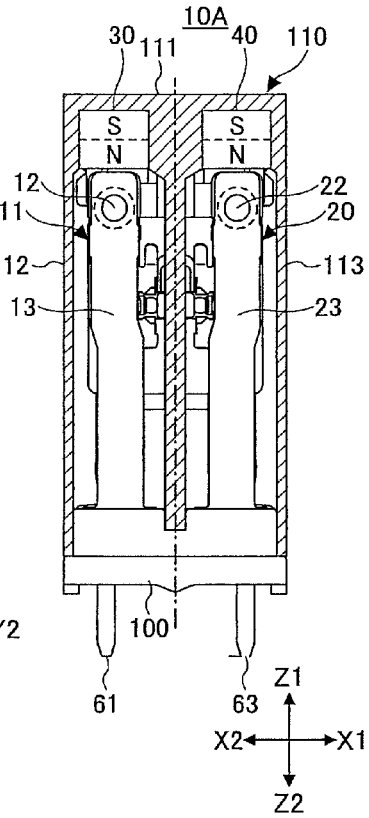
Figure 5D:
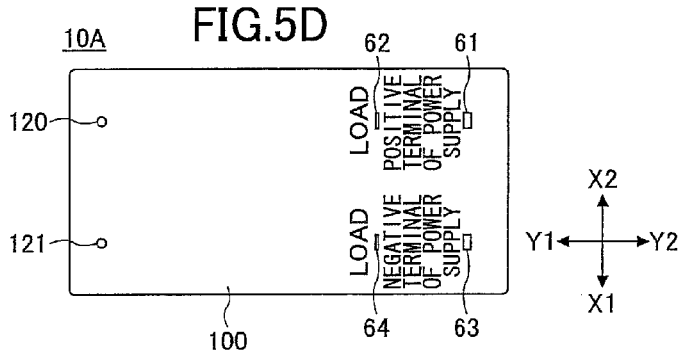

Referring to FIG. 5D, an indication such as "POSITIVE TERMINAL OF POWER SUPPLY" is provided for each of the terminals 61 through 64 on the bottom surface of the base 100 with letters formed by resin molding. It is specified with an indication "POSITIVE TERMINAL OF POWER SUPPLY" that the terminal 61 is to be connected to the positive terminal of a power supply. It is specified with an indication "NEGATIVE TERMINAL OF POWER SUPPLY" that the terminal 63 is to be connected to the negative terminal of the power supply. It is specified with an indication "LOAD" that the terminal 62 is to be connected to one end of a load circuit. It is specified with an indication "LOAD" that the terminal 64 is to be connected to the other end of the load circuit. Alternatively, these specifications may be made with indications directly printed on the surface of a side plate part 112 or 113 (FIGS. 5A and 5C) or the upper surface of the top plate part 111 of the case 110 or may be made by attaching a label on which the specifications are printed to the case 110.

The same as shown in FIGS. 1 and 2, the relay 10A is mounted on the printed circuit board 80 and used, being provided over the first circuit interconnection 73 and the second circuit interconnection 74 with the terminals 61, 62, 63, and 64 inserted into and soldered to the through holes 81, 82, 83, and 84, respectively, and the terminals 120 and 121 inserted into and soldered to corresponding through holes. Alternatively, the terminals 61, 62, 63, and 64 linearly projecting downward from the bottom surface of the base 100 may be replaced with L-shaped terminals, so that the relay 10A may be surface-mounted on a printed circuit board by soldering the L-shaped terminals to corresponding pads on the printed circuit board.

Here, the magnetizing coil 16 has no polarity, so that the direction of current to the magnetizing coil 16 is not specified. As a result, the constraints of a circuit for driving the relay 10A are reduced.

When the magnetizing coil 16 is not energized, the relay 10A is in a condition shown in FIG. 4 and FIGS. 5A through 5D, where the first and second movable contacts 14 and 24 are out of contact with the first and second fixed contacts 12 and 22, respectively.

When a direct current flows through the magnetizing coil 16 through the terminals 120 and 121, the magnetizing coil unit 105 is excited, so that the horizontal part of the armature 103 is attracted and adhered to the magnetizing coil unit 105. As a result of this operation of the armature 103, the first and second movable spring terminals 15 and 25 are pressed in the Y2 direction, so that the first and second movable contacts 14 and 24 come into contact with the first and second fixed contacts 12 and 22, respectively. Thereby, the relay 10A is closed. As a result, current flows as indicated by arrows in FIG. 1, so that the load circuit 72 operates.

When energization of the magnetizing coil 16 is stopped, the first movable contact 14 moves out of contact with the first fixed contact 12, and at the same time, the second movable contact 24 moves out of contact with the second fixed contact 22, so that an arc is generated in each of the first gap 17 and the second gap 27. The movable contacts 14 and 24 and the fixed contacts 12 and 22 are thin disks, and their surfaces facing each other are spherical. Accordingly, the arcs are generated between the centers of the movable contacts 14 and 24 and the centers of the fixed contacts 12 and 22. As shown in FIG. 5A, however, the arc in the first gap 17 is deflected and blown off in the X2 direction as indicated by reference numeral 90 so as to be immediately extinguished by the Lorentz force F2 generated based on Fleming's left-hand rule by the action of the magnetic force of the first permanent magnet piece 30, and the arc in the second gap 27 is deflected and blown off in the X1 direction as indicated by reference numeral 91 so as to be immediately extinguished by the Lorentz force F1 generated based on Fleming's left-hand rule by the action of the magnetic force of the second permanent magnet piece 40.

Figure 6:
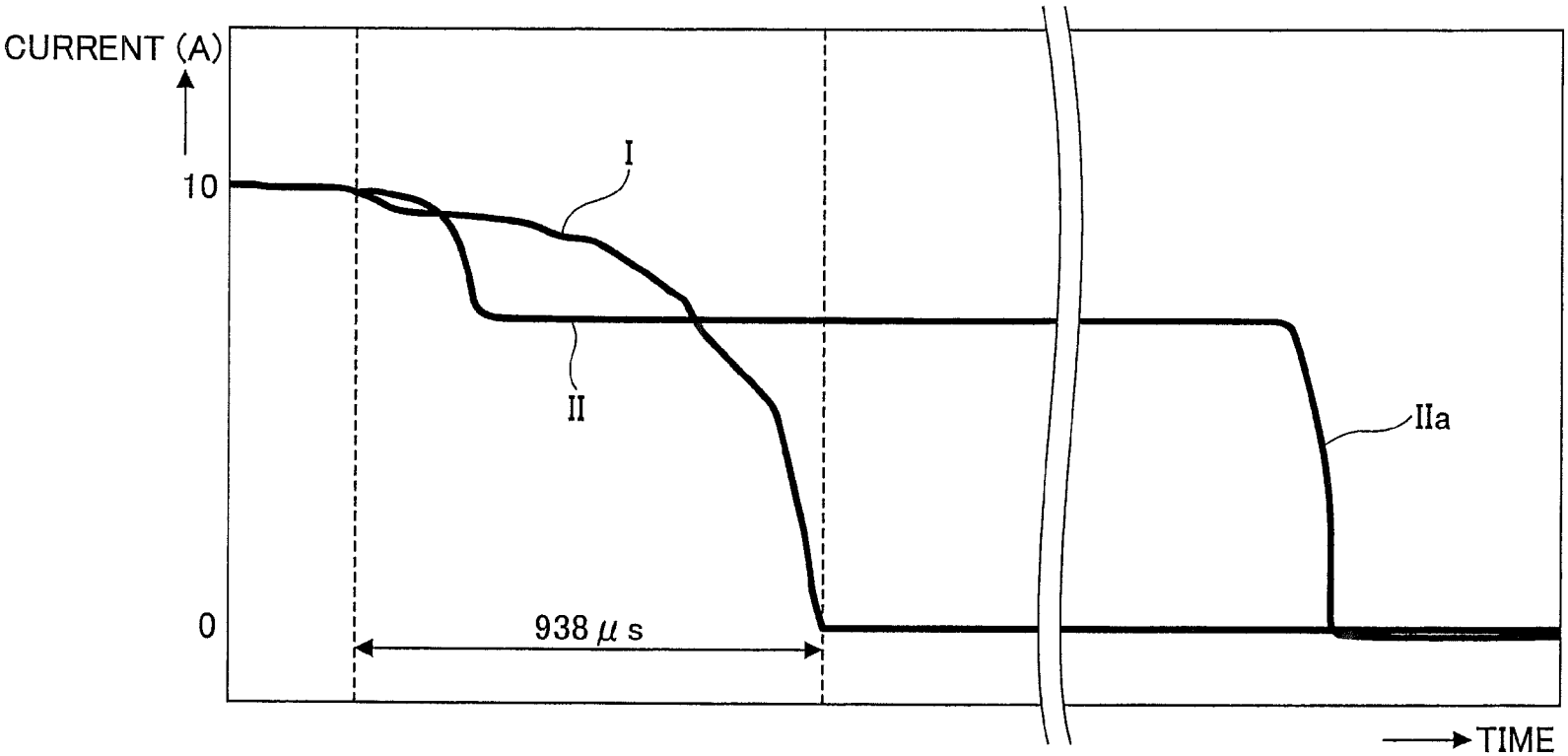
FIG. 6 is a graph for illustrating interruption of circuit current by the relay according to the first embodiment of the present invention.

FIG. 6 is a graph showing interruption waveforms of circuit current in the case of a voltage of 400 VDC and a current of 10 A.

As a result of immediate extinction of the arcs in the gaps 17 and 27, the circuit current flowing through the electric circuit 70 is immediately interrupted in, for example, 938 μs as indicated by Waveform I in FIG. 6. Further, the movable contacts 14 and 24 and the fixed contacts 12 and 22 are prevented from being damaged, so that the relay 10A has a long useful service life without degradation of its performance even after multiple opening and closing operations.

The arc generated in the first gap 17 comes into contact with the X2-side side plate part 112 of the case 110 as indicated by reference numeral 90, and the arc generated in the second gap 27 comes into contact with the X1-side side plate part 113 of the case 110 as indicated by reference numeral 91. However, since the case 110 is formed of a material highly resistant to heat, the interior surfaces of the side plate parts 112 and 113 are not damaged. Further, a melt (melted material) in the arcs may be adhered to and deposited on the interior surfaces of the side plate parts 112 and 113. However, since the interior surfaces of the side plate parts 112 and 113 are away from the gaps 17 and 27, respectively, by a distance A of approximately 2 mm to 4 mm, the first and second opening and closing parts 11 and 20 are not affected, so that no problem is caused.

If the arcs are not deflected, the arcs remain and continue to be present in the gaps 17 and 27, so that the movable contacts 14 and 24 and the fixed contacts 12 and 22 are severely damaged and melt away. In this case, the circuit current flowing through the electric circuit 70 is as indicated by Waveform II in FIG. 6, where the part of Waveform II indicated by IIa shows that the movable contacts 14 and 24 and the fixed contacts 12 and 22 have melted away.

Figure 10:
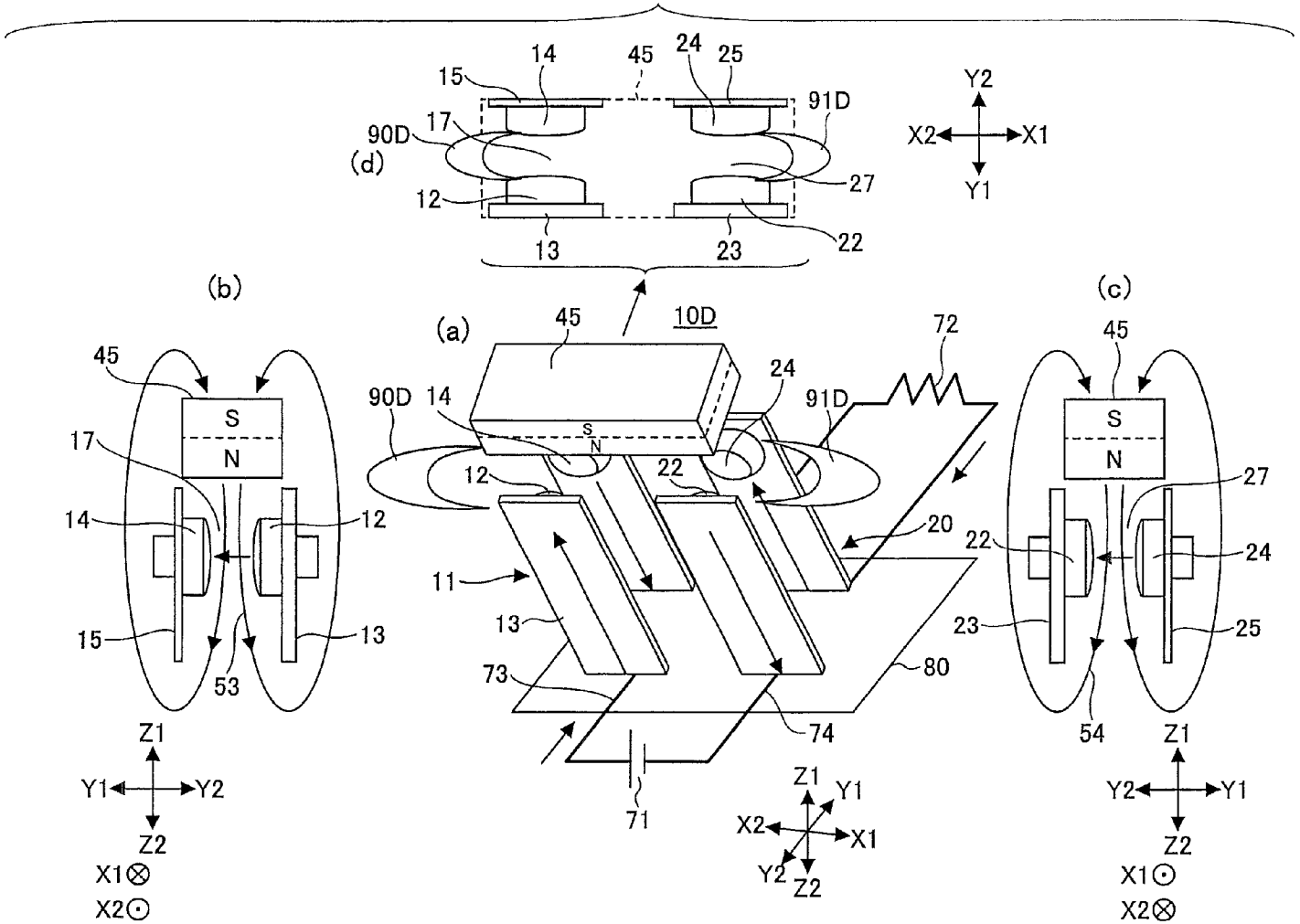
FIG. 10 is a schematic diagram showing a relay according to a third embodiment of the present invention.

Since the first and second permanent magnet pieces 30 and 40 are separate, the volume of the permanent magnet material is reduced so that the material cost is reduced compared with the case of combining the first and second permanent magnet pieces 30 and 40 into a single permanent magnet piece as described below (FIG. 10).

Further, since the permanent magnet pieces 30 and 40 that cause arcs to be blown off are provided above (on the Z1 side of) the gaps 17 and 27, respectively, it is possible to optimize the design of the magnetizing coil unit 105 serving as the magnetization driving part of the relay 10A without considering the presence of the permanent magnet pieces 30 and 40.

Next, a description is given of variations of the case 110, the permanent magnet pieces 30 and 40, and the fixation structure of the permanent magnet pieces 30 and 40 according to this embodiment.

The case 110 may be formed by insert molding using a ceramic case member and thermoplastic resin such as an ABS (Acrylonitrile Butadiene Styrene) resin, a PBT (polybutylene terephthalate) resin, or an LCP (Liquid Crystal Polymer) resin. Further, parts of the case 110 which become high in temperature, that is, the parts of the side plate parts 112 and 113 facing the gaps 17 and 27, may be formed of, for example, an epoxy resin or phenolic resin.

The first and second permanent magnet pieces 30 and 40 may also be neodymium magnets or ferrite magnets.

Figure 7:
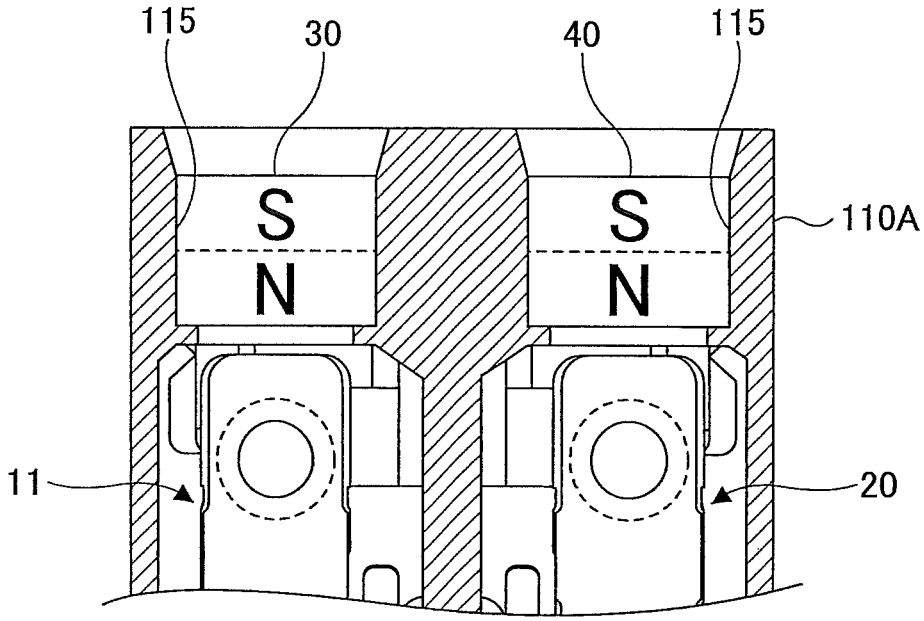
FIG. 7 is a diagram showing another structure of fixing permanent magnets to the case according to the first embodiment of the present invention.

The fixation structure of the first and second permanent magnet pieces 30 and 40 may also be such that a case 110A has recesses 115 on the upper surface of its top plate part and the permanent magnet pieces 30 and 40 are press-fitted into the recesses 115 as shown in FIG. 7. Alternatively, the permanent magnet pieces 30 and 40 may be adhered to the lower surface of the top plate part of the case using double-sided adhesive tape, or the permanent magnet pieces 30 and 40 may be adhered to the top plate part of the case using an adhesive agent, or the permanent magnet pieces 30 and 40 may be fixed to the top plate part of the case using a tackiness agent, or the permanent magnet pieces 30 and 40 may be press-fitted into corresponding recesses formed in the case for temporary assembly and then adhered to the corresponding recesses with an adhesive agent.

Second Embodiment

Figure 8A:
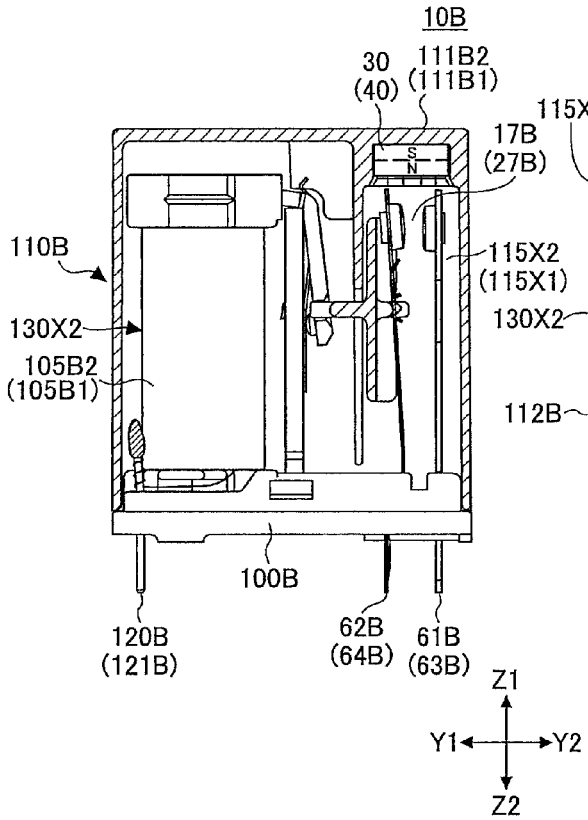
FIGS. 8A through 8C are an X2-side cut-away view, a Y2-side cut-away view, and a bottom plan view, respectively, of a relay according to a second embodiment of the present invention.
Figure 8B:
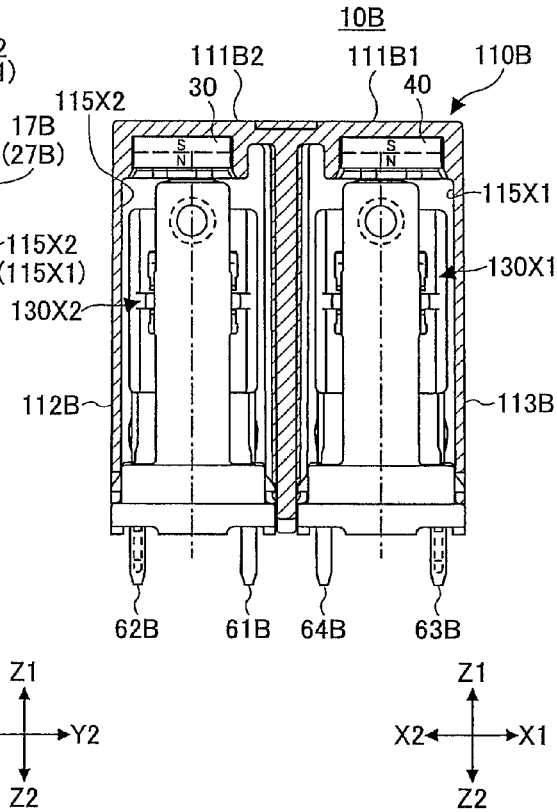
Figure 8C:
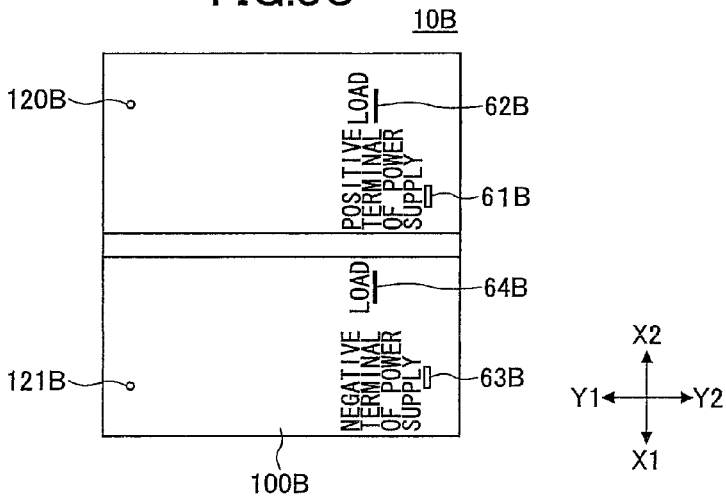

FIGS. 8A through 8C are an X2-side cut-away view, a Y2-side cut-away view, and a bottom (Z2-side) plan view, respectively, of a relay 10B according to a second embodiment of the present invention.

The relay 10B includes two relay main bodies 130X1 and 130X2 incorporated and arranged side by side in the X1-X2 directions in a case 110B. Each of the relay main bodies 130X1 and 130X2 has the same configuration as a relay main body 130 shown in FIG. 9.

The case 110B includes a relay main body housing part 115X1 for housing the relay main body 130X1 and a relay main body housing part 115X2 for housing the relay main body 130X2. The relay main body housing parts 115X1 and 115X2 are formed side by side in the X1-X2 directions. The first and second permanent magnet pieces 30 and 40 are fixed to a top plate part 111B2 of the relay main body housing part 115X2 and a top plate part 111B1 of the relay main body housing part 115X1, respectively.

Figure 9:
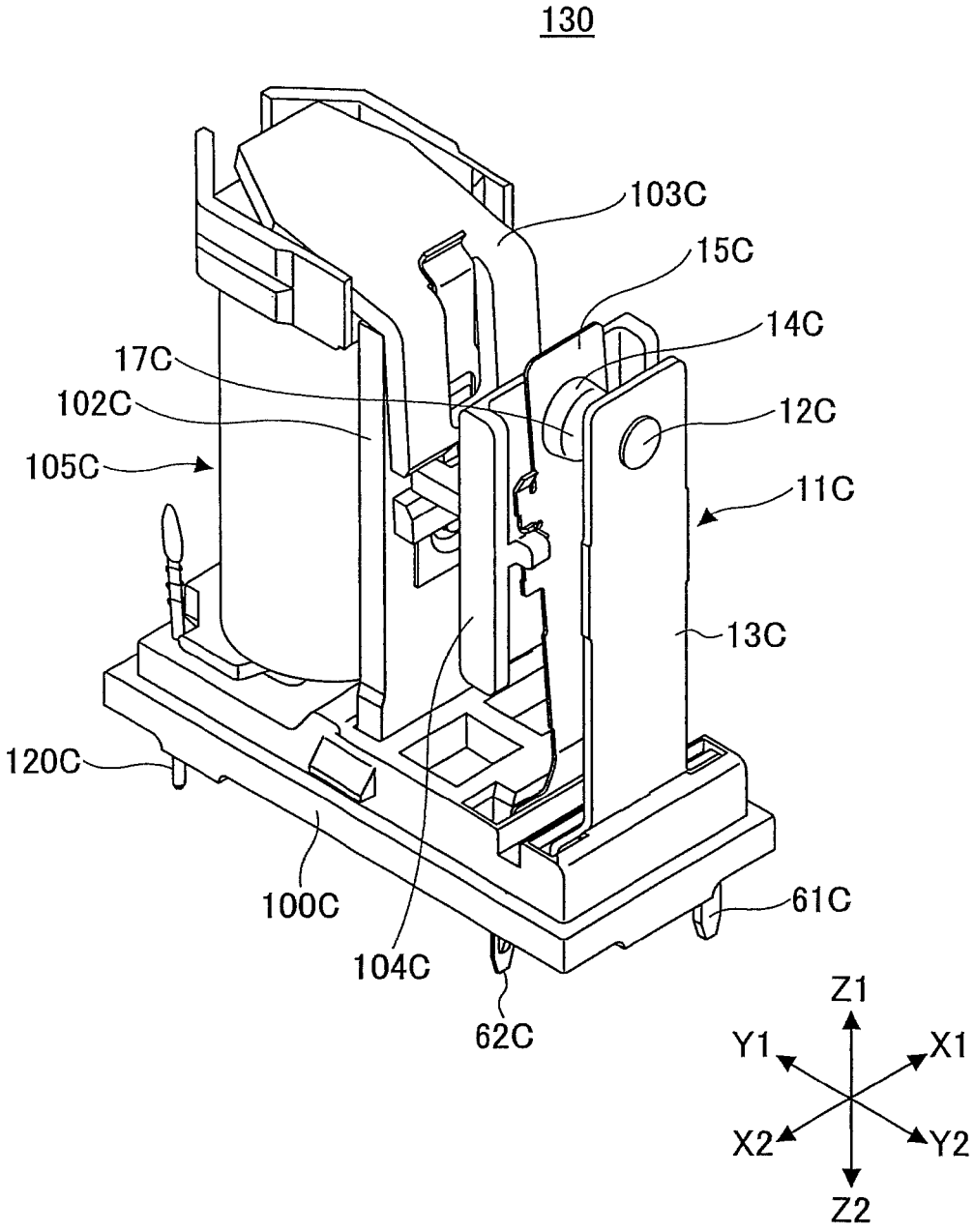
FIG. 9 is a perspective view of a relay main body according to the second embodiment of the present invention.

Referring to FIG. 9, the relay main body 130 includes an opening and closing part 11C on a base 100C on its Y2 side; a yoke 102C provided in a vertical (standing) position in the center of the base 100C; an armature 103C and a card 104C provided in the center of the base 100C; a magnetizing coil unit 105C mounted on and fixed to the base 100C on its Y1 side; and terminals 61C and 62C and a terminal 120C projecting from the lower surface of the base 100C.

The opening and closing part 11C has a fixed spring terminal 13C having a fixed contact 12C and a movable spring terminal 15C having a movable contact 14C. The fixed spring terminal 13C and the movable spring terminal 15C are arranged so as to face each other so that the fixed contact 12C and the movable contact 14C face each other across a gap 17C formed therebetween.

The relay main body 130X1 is incorporated in the relay main body housing part 115X1, and the relay main body 130X2 is incorporated in the relay main body housing part 115X2. The relay main body 130X2 has a first gap 17B (corresponding to the gap 17C of FIG. 9), and the relay main body 130X1 has a second gap 27B (corresponding to the gap 17C of FIG. 9). Each of the first and second permanent magnet pieces 30 and 40 is oriented so as to have a north pole on the Z2 side and a south pole on the Z1 side, and the magnetic fields acting on the gaps 17B and 27B have the same orientation. The magnetizing coil of a magnetizing coil unit 105B1 of the relay main body 130X1 and the magnetizing coil of a magnetizing coil unit 105B2 of the relay main body 130X2 are connected in series.

Terminals 61B and 62B (corresponding to the terminals 61C and 62C, respectively, of FIG. 9), terminals 63B and 64B (corresponding to the terminals 61C and 62C, respectively, of FIG. 9), and terminals 120B and 121B (each corresponding to the terminal 120C of FIG. 9) connected to the corresponding ends of the magnetizing coils connected in series are projecting downward from a base 100B of the relay 10B. Referring to FIG. 8C, letter indications are provided on the lower surface of the base 100B. It is specified that the terminal 61B is to be connected to the positive terminal of a power supply. It is specified that the terminal 63B is to be connected to the negative terminal of the power supply. It is specified that the terminal 62B is to be connected to one end of a load circuit. It is specified that the terminal 64B is to be connected to the other end of the load circuit.

The same as shown in FIGS. 1 and 2, the relay 10B is mounted on the printed circuit board 80 and used, being provided over the first circuit interconnection 73 and the second circuit interconnection 74 with the terminals 61B, 62B, 63B, and 64B inserted into and soldered to the through holes 81, 82, 83, and 84, respectively, and the terminals 120B and 121B inserted into and soldered to corresponding through holes.

The relay 10B operates with the relay main body 130X1 and the relay main body 130X2 operating simultaneously. The arcs generated in the gaps 17B and 27B during the operation of the relay 10B are both deflected outward and blown off toward a side plate part 112B and a side plate part 113B, respectively, so as to be immediately extinguished the same as in the case of the above-described relay 10A of the first embodiment. Therefore, the movable contact (corresponding to the movable contact 14C of FIG. 9) and the fixed contact (corresponding to the fixed contact 12C of FIG. 9) of each of the relay main bodies 130X1 and 130X2 are prevented from being damaged, so that the relay 10B has a long useful service life.

Third Embodiment

FIG. 10 is a schematic diagram showing a relay 10D according to a third embodiment of the present invention.

Figure 11:
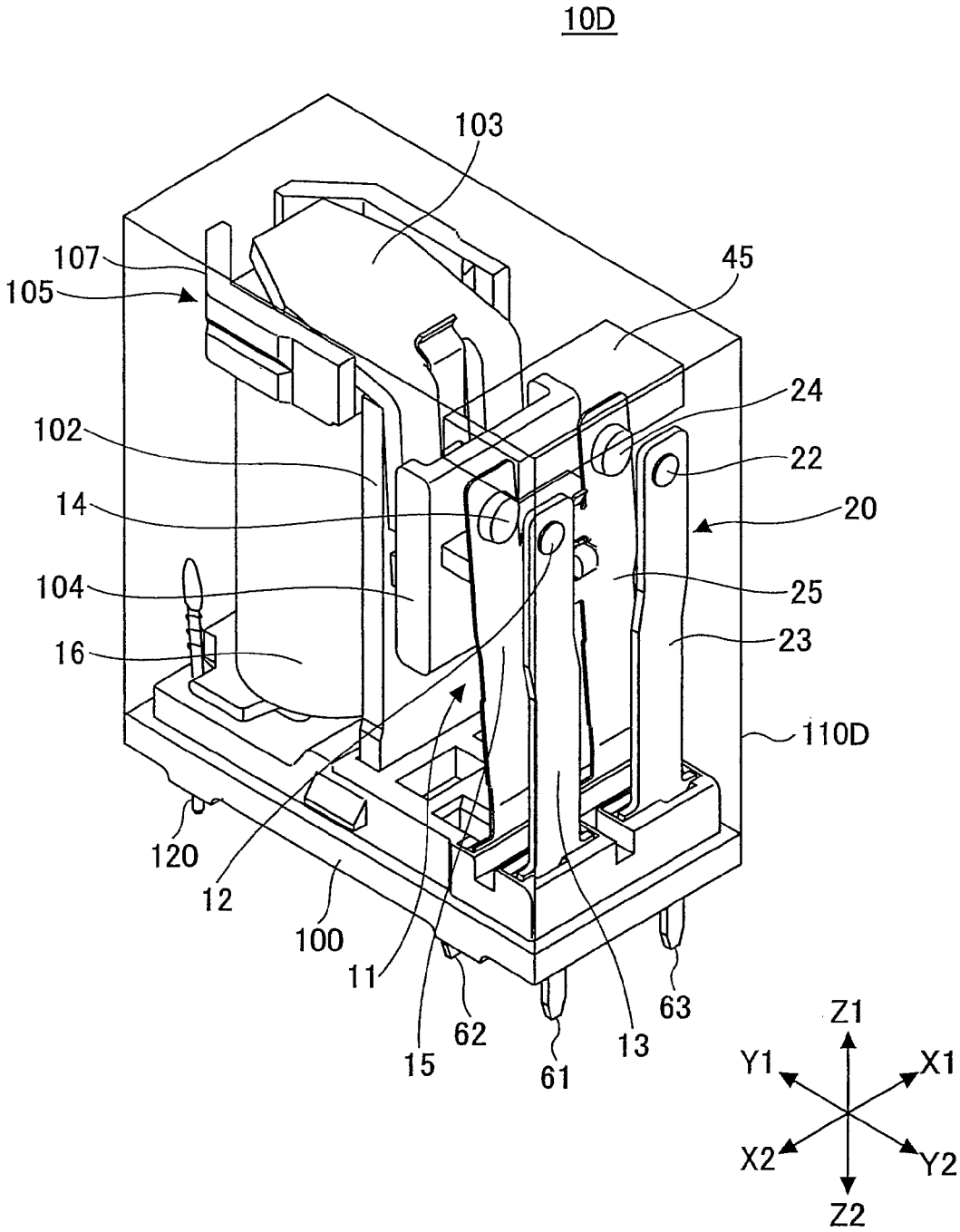
FIG. 11 is a perspective view of the relay, showing the relay through a case, according to the third embodiment of the present invention.

FIG. 11 is a perspective view of the relay 10D, showing the relay 10D through a case 110D thereof.

FIGS. 12A through 12D are a top (Z1-side) cut-away view, an X2-side cut-away view, a Y2-side cut-away view, and a bottom (Z2-side) plan view, respectively, of the relay 10D.

The relay 10D of the third embodiment has the same configuration as the relay 10 shown in FIG. 1 except that the first and second permanent magnet pieces 30 and 40 of the relay 10 shown in FIG. 1 are replaced with a common, single permanent magnet piece 45.

The permanent magnet piece 45 has a long, narrow rectangular parallelepiped shape extending over the gap 17 and the gap 27 with its north pole on the Z2 side and its south pole on the Z1 side. This configuration with the monolithic permanent magnet piece 45 is possible because of the configuration of applying magnetic fields of the same orientation on the gap 17 and the gap 27.

In practice, the permanent magnet piece 45 is incorporated in the lower surface of a top plate part 111D of a case 110D so as to be placed immediately above the gap 17 and the gap 27 as shown in FIGS. 12A through 12D. Magnetic fields of the same orientation act on the gap 17 and the gap 27.

Figure 12A:
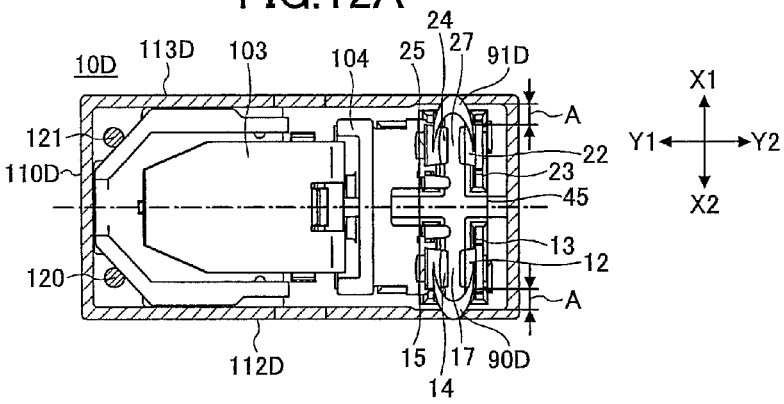
FIGS. 12A through 12D are a top cut-away view, an X2-side cut-away view, a Y2-side cut-away view, and a bottom plan view, respectively, of the relay of FIG. 11 according to the third embodiment of the present invention.
Figure 12B:
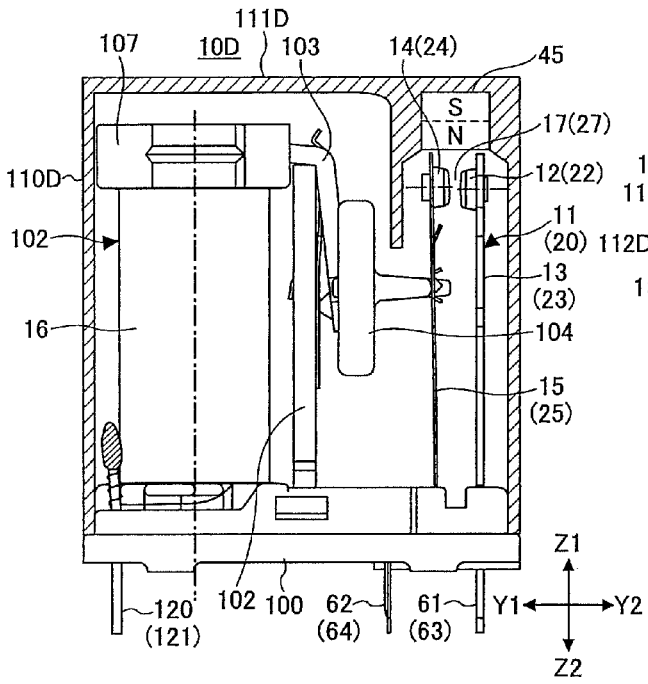
Figure 12C:
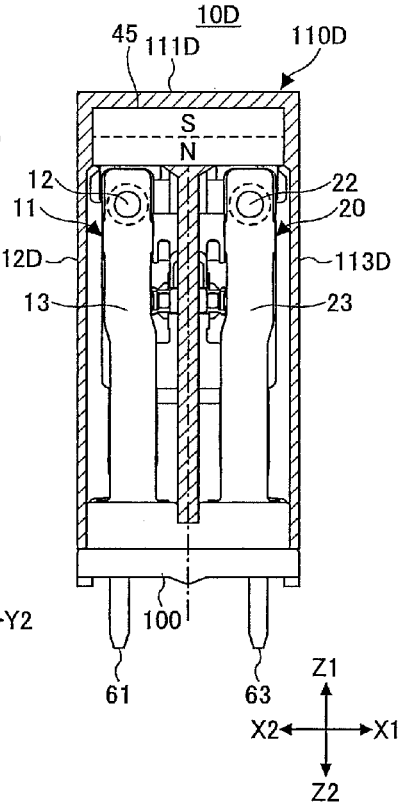
Figure 12D:
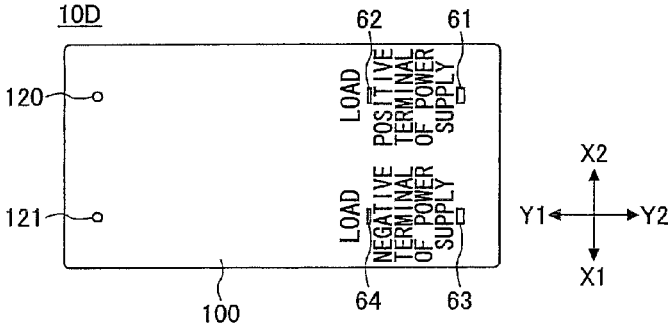

The arcs generated in the gaps 17 and 27 when the relay 10D is in operation are both deflected outward and blown off toward side plate parts 112D and 113D as indicated by reference numerals 90D and 91D, respectively, in FIG. 12A so as to be immediately extinguished the same as in the case of the relay 10A of the first embodiment. Accordingly, the movable contacts 14 and 24 and the fixed contacts 12 and 22 of the relay 10D are prevented from being damaged, so that the relay 10 enjoys a long useful service life.

Compared with the above-described configuration of providing the first permanent magnet piece 30 and the second permanent magnet piece 40 separately, this configuration of employing the single permanent magnet piece 45 can reduce the number of components and eliminate the processing cost of dividing a permanent magnet into pieces.

Fourth Embodiment

Figure 13:
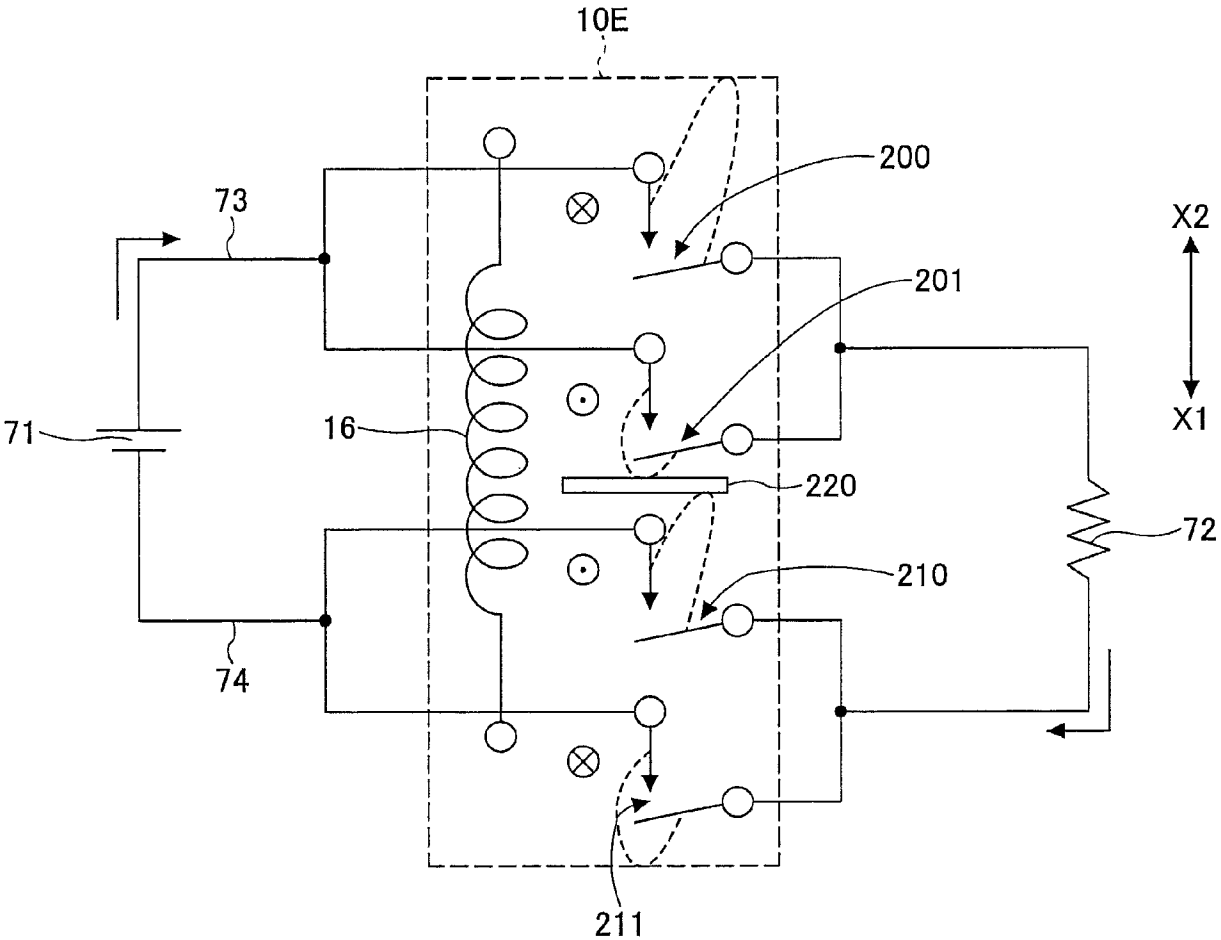
FIG. 13 is a schematic diagram showing a relay according to a fourth embodiment of the present invention.

FIG. 13 is a schematic diagram showing a relay 10E according to a fourth embodiment of the present invention.

The relay 10E includes two opening and closing parts 200 and 201 corresponding to the first circuit interconnection 73 and two opening and closing parts 210 and 211 corresponding to the second circuit interconnection 74, and has the four opening and closing parts 200, 201, 210, and 211 incorporated into a single case (not graphically illustrated). When the circuit pattern of the printed circuit board 80 has a branching parallel circuit part formed in the middle of each of the first and second circuit interconnections 73 and 74, this relay 10E is mounted over both of the parallel circuit parts and used.

The case includes a wall part 220 separating the opening and closing part 201 and the opening and closing part 210. A permanent magnet piece (not graphically illustrated) is provided for each of the opening and closing parts 200, 201, 210, and 211. The magnetic poles of the permanent magnet pieces are oriented so that a magnetic field in the direction going into the plane of the paper of FIG. 13 acts on each of the opening and closing parts 200 and 211 and a magnetic field in the direction coming out of the plane of the paper of FIG. 13 acts on each of the opening and closing parts 201 and 210.

The arcs generated in the opening and closing parts 200 and 211 are both blown off toward the interior surface of the case in the X2 direction and the X1 direction, respectively. The arcs generated in the opening and closing parts 201 and 210 are both blown off toward the wall part 220 in the X1 direction and the X2 direction, respectively.

The permanent magnet pieces facing the opening and closing parts 201 and 210 may be replaced with a long, narrow permanent magnet piece large enough to extend over the opening and closing parts 201 and 210.

According to this relay 10E, it is possible to reduce current flowing through each of the opening and closing parts 200, 201, 210, and 211.

Fifth Embodiment

Figure 14:
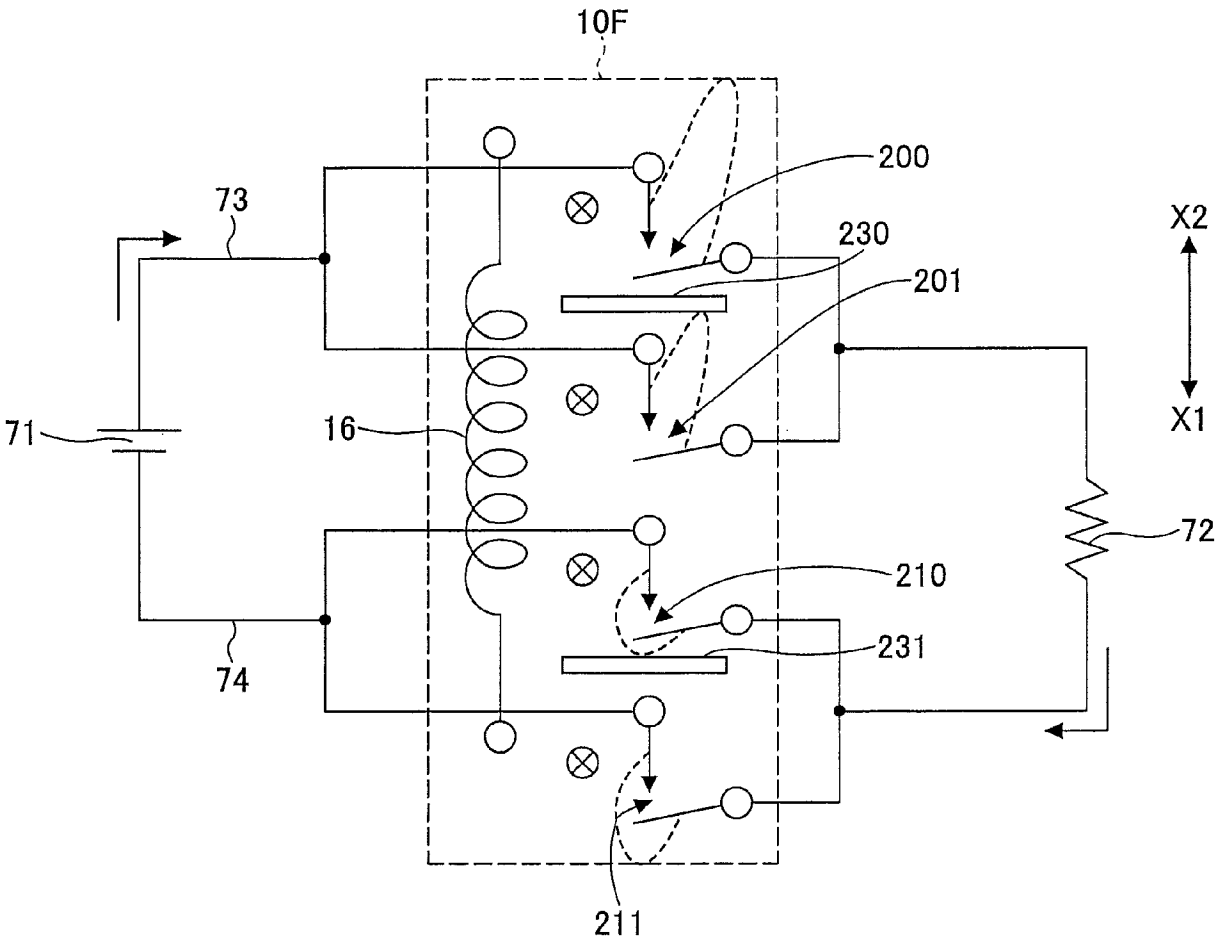
FIG. 14 is a schematic diagram showing a relay according to a fifth embodiment of the present invention.

FIG. 14 is a schematic diagram showing a relay 10F according to a fifth embodiment of the present invention.

The relay 10F of this embodiment is different from the relay 10E of FIG. 13 (fourth embodiment) in that a wall part 230 that separates the opening and closing parts 200 and 201 and a wall part 231 that separates the opening and closing parts 210 and 211 are provided in place of the wall part 220 of FIG. 13 and that the magnetic poles of the permanent magnet pieces provided for the corresponding opening and closing parts 200, 201, 210, and 211 are oriented so that a magnetic field in the direction going into the plane of the paper of FIG. 14 acts on each of the opening and closing parts 200, 201, 210, and 211.

The arc generated in the opening and closing part 200 is blown off toward the interior surface of the case in the X2 direction. The arc generated in the opening and closing part 201 is blown off toward the wall part 230 in the X2 direction.

The arc generated in the opening and closing part 210 is blown off toward the wall part 231 in the X1 direction. The arc generated in the opening and closing part 211 is blown off toward the interior surface of the case in the X1 direction.

The permanent magnet pieces facing the opening and closing parts 200 and 201 may be replaced with a long, narrow permanent magnet piece large enough to extend over the opening and closing parts 200 and 201. The permanent magnet pieces facing the opening and closing parts 210 and 211 may be replaced with a long, narrow permanent magnet piece large enough to extend over the opening and closing parts 210 and 211. Alternatively, the permanent magnet pieces facing the opening and closing parts 200, 201, 210, and 211 may be replaced with a long, narrow permanent magnet piece large enough to extend over the opening and closing parts 200, 201, 210, and 211.

According to the relay 10F, it is possible to reduce current flowing through each of the opening and closing parts 200, 201, 210, and 211 the same as in the above-described relay 10E of the fourth embodiment.

Sixth Embodiment

Figure 15:
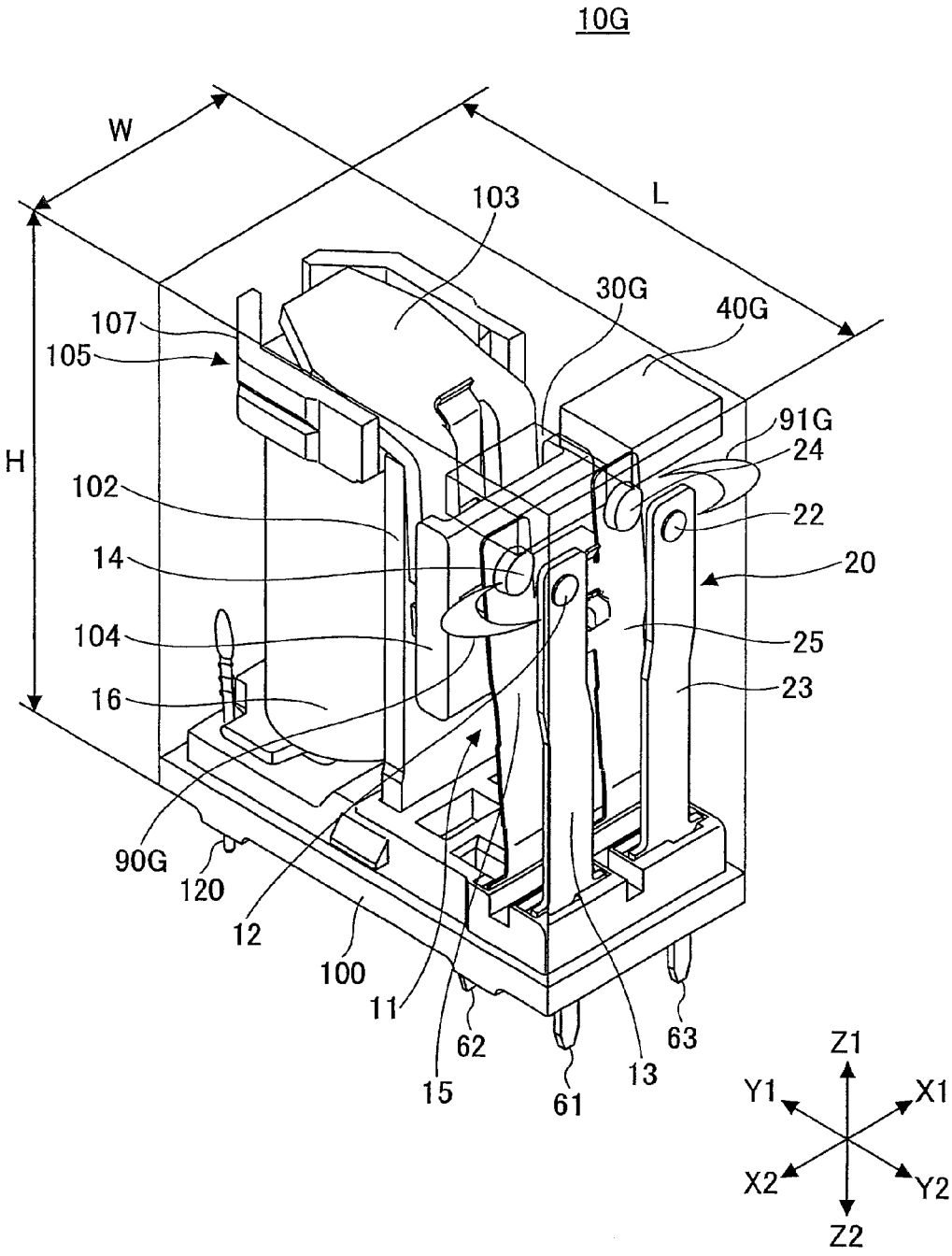
FIG. 15 is a perspective view of a relay, showing the relay through a case, according to a sixth embodiment of the present invention.

FIG. 15 is a diagram showing a relay 10G according to a sixth embodiment of the present invention.

The relay 10G of this embodiment is different from the relay 10A of FIG. 4 (first embodiment) in having first and second magnet pieces 30G and 40G in place of the first and second magnet pieces 30 and 40.

Figure 16A:
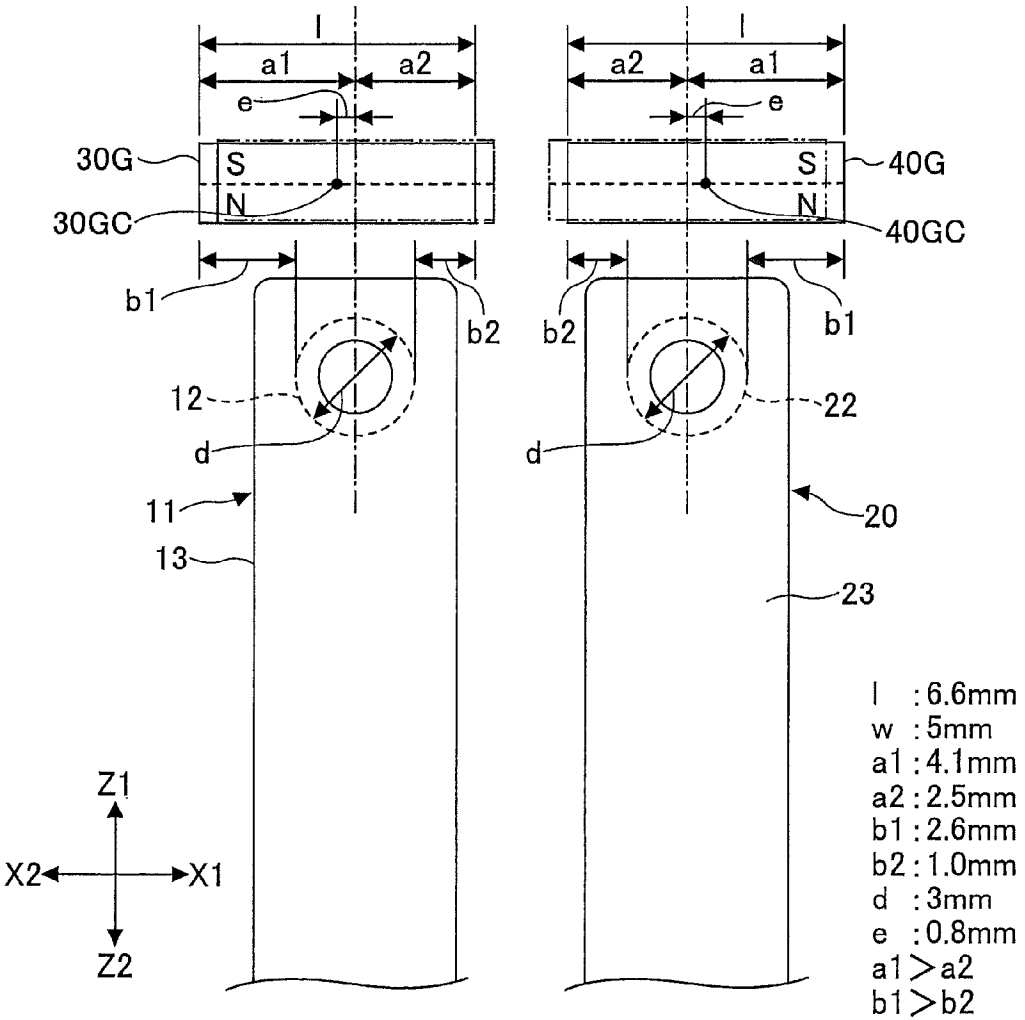
FIGS. 16A and 16B are diagrams showing the positional relationship between first and second permanent magnet pieces and first and second gaps according to the sixth embodiment of the present invention.
Figure 16B:
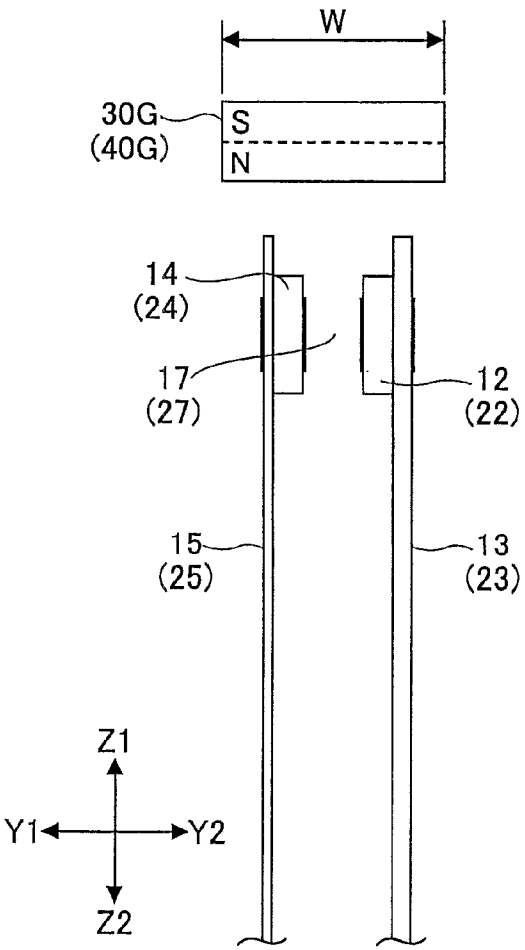

FIGS. 16A and 16B are diagrams showing the positional relationship between the first and second permanent magnet pieces 30G and 40G and the first and second gaps 17 and 27.

Each of the fixed contacts 12 and 22 has a diameter d of 3 mm.

Each of the first and second permanent magnet pieces 30G and 40G is a flat rectangular parallelepiped and has a length l of 6.6 mm (in the X1-X2 directions) and a width w of 5 mm (in the Y1-Y2 directions). The length l is greater than the diameter d of the fixed contacts 12 and 22 (l>d), and is approximately twice the diameter d of the fixed contacts 12 and 22.

The first permanent magnet piece 30G faces the first gap 17 immediately above (on the Z1 side of) the first gap 17. A center 30GC of the first permanent magnet piece 30G in the X1-X2 directions is offset by a dimension e (approximately 0.8 mm) in the X2 direction (in which the arc generated in the first gap 17 is blown off) with respect to the center of the fixed contact 12. Accordingly, in the first permanent magnet piece 30G, a length a1 (approximately 4.1 mm) of a portion extending in the X2 direction relative to the center of the fixed contact 12 and a length b1 (approximately 2.6 mm) of a portion extending in the X2 direction relative to the X2-side edge of the fixed contact 12 are greater than in the case of placing the first permanent magnet piece 30G so that the center 30GC of the first permanent magnet piece 30G is aligned with a line in the Z1-Z2 directions passing through the center of the fixed contact 12 (as indicated by a two-dot chain line in FIG. 16A).

Further, in the first permanent magnet piece 30G, the length a1 (approximately 4.1 mm) of the portion on the X2 side relative to the center of the fixed contact 12 is greater than a length a2 (approximately 2.5 mm) of a portion on the X1 side relative to the center of the fixed contact 12 (a1>a2), and the length b1 (approximately 2.6 mm) of the portion extending in the X2 direction relative to the X2-side edge of the fixed contact 12 is greater than a length b2 (approximately 1.0 mm) of a portion extending in the X1 direction relative to the X1-side edge of the fixed contact 12 (b1>b2).

Accordingly, compared with the case of placing the first permanent magnet piece 30G so that the center 30GC of the first permanent magnet piece 30G is aligned with the line in the Z1-Z2 directions passing through the center of the fixed contact 12, the space covered by the magnetic field applied by the first permanent magnet piece 30G is more extensive in the X2 direction than in the X1 direction from the first gap 17. That is, the limited magnetic field from the first permanent magnet piece 30G acts on the arc with efficiency.

Accordingly, when the arc generated in the gap 17 is deflected in the X2 direction by the action of the magnetic force of the first permanent magnet piece 30G as indicated by reference numeral 90G in FIG. 15, the magnetic field by the first permanent magnet piece 30G acts on the deflected arc with efficiency, so that the arc is satisfactorily blown off and immediately extinguished compared with the case in the relay 10A shown in FIG. 4 (first embodiment).

The second permanent magnet piece 40G faces the second gap 27 immediately above (on the Z1 side of) the second gap 27. A center 40GC of the second permanent magnet piece 40G in the X1-X2 directions is offset by the dimension e (approximately 0.8 mm) in the X1 direction (in which the arc generated in the second gap 27 is blown off) with respect to the center of the fixed contact 22. Accordingly, in the second permanent magnet piece 40G, the length a1 (approximately 4.1 mm) of a portion extending in the X1 direction relative to the center of the fixed contact 22 and the length b1 (approximately 2.6 mm) of a portion extending in the X1 direction relative to the X1-side edge of the fixed contact 22 are greater than in the case of placing the second permanent magnet piece 40G so that the center 40GC of the second permanent magnet piece 40G is aligned with a line in the Z1-Z2 directions passing through the center of the fixed contact 22 (as indicated by a two-dot chain line in FIG. 16A).

Further, in the second permanent magnet piece 40G, the length a1 (approximately 4.1 mm) of the portion on the X1 side relative to the center of the fixed contact 22 is greater than the length a2 (approximately 2.5 mm) of a portion on the X2 side relative to the center of the fixed contact 22 (a1>a2), and the length b1 (approximately 2.6 mm) of the portion extending in the X1 direction relative to the X1-side edge of the fixed contact 22 is greater than the length b2 (approximately 1.0 mm) of a portion extending in the X2 direction relative to the X2-side edge of the fixed contact 22 (b1>b2).

Accordingly, compared with the case of placing the second permanent magnet piece 40G so that the center 40GC of the second permanent magnet piece 40G is aligned with the line in the Z1-Z2 directions passing through the center of the fixed contact 22, the space covered by the magnetic field applied by the second permanent magnet piece 40G is more extensive in the X1 direction than in the X2 direction from the second gap 27. That is, the limited magnetic field from the second permanent magnet piece 40G acts on the arc with efficiency.

Accordingly, when the arc generated in the gap 27 is deflected in the X1 direction by the action of the magnetic force of the second permanent magnet piece 40G as indicated by reference numeral 91G in FIG. 15, the magnetic field by the second permanent magnet piece 40G acts on the deflected arc with efficiency, so that the arc is satisfactorily blown off and immediately extinguished compared with the case in the relay 10A shown in FIG. 4 (first embodiment).

Seventh Embodiment

Figure 17:
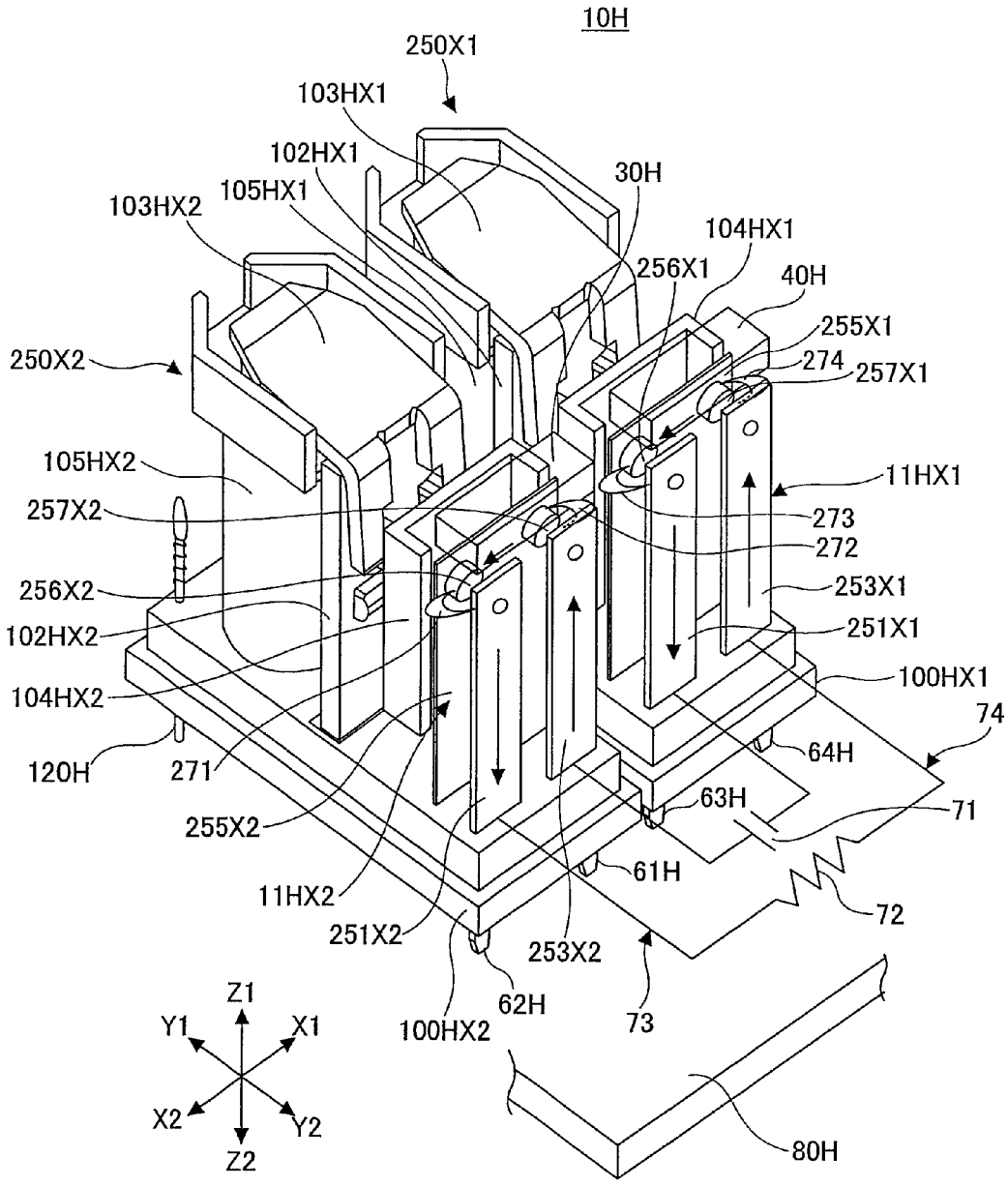
FIG. 17 is a perspective view of a relay without a case, where permanent magnet pieces are shown as transparent, according to a seventh embodiment of the present invention.

FIG. 17 is a perspective view of a relay 10H without a case 110H (FIGS. 18A and 18B) according to a seventh embodiment of the present invention. In FIG. 17, first and second permanent magnet pieces 30H and 40H are shown as transparent for convenience of description.

Figures 18A, 18B, 18C:
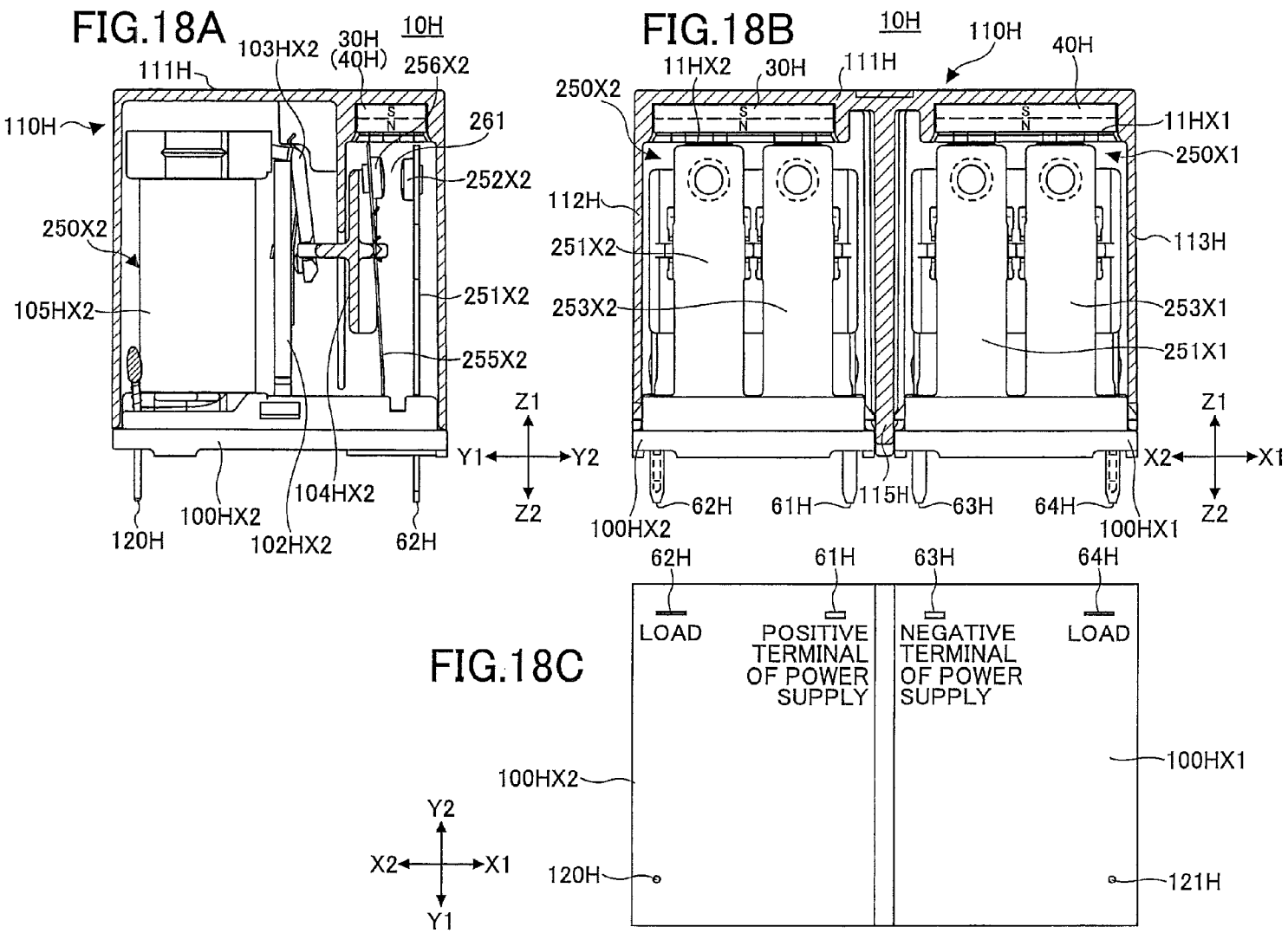
FIGS. 18A through 18C are an X2-side cut-away view, a Y2-side cut-away view, and a bottom plan view, respectively, of the relay of FIG. 17 according to the seventh embodiment of the present invention.

FIGS. 18A through 18C are an X2-side cut-away view, a Y2-side cut-away view, and a bottom (Z2-side) plan view, respectively, of the relay 10H of FIG. 17.

Figure 19:
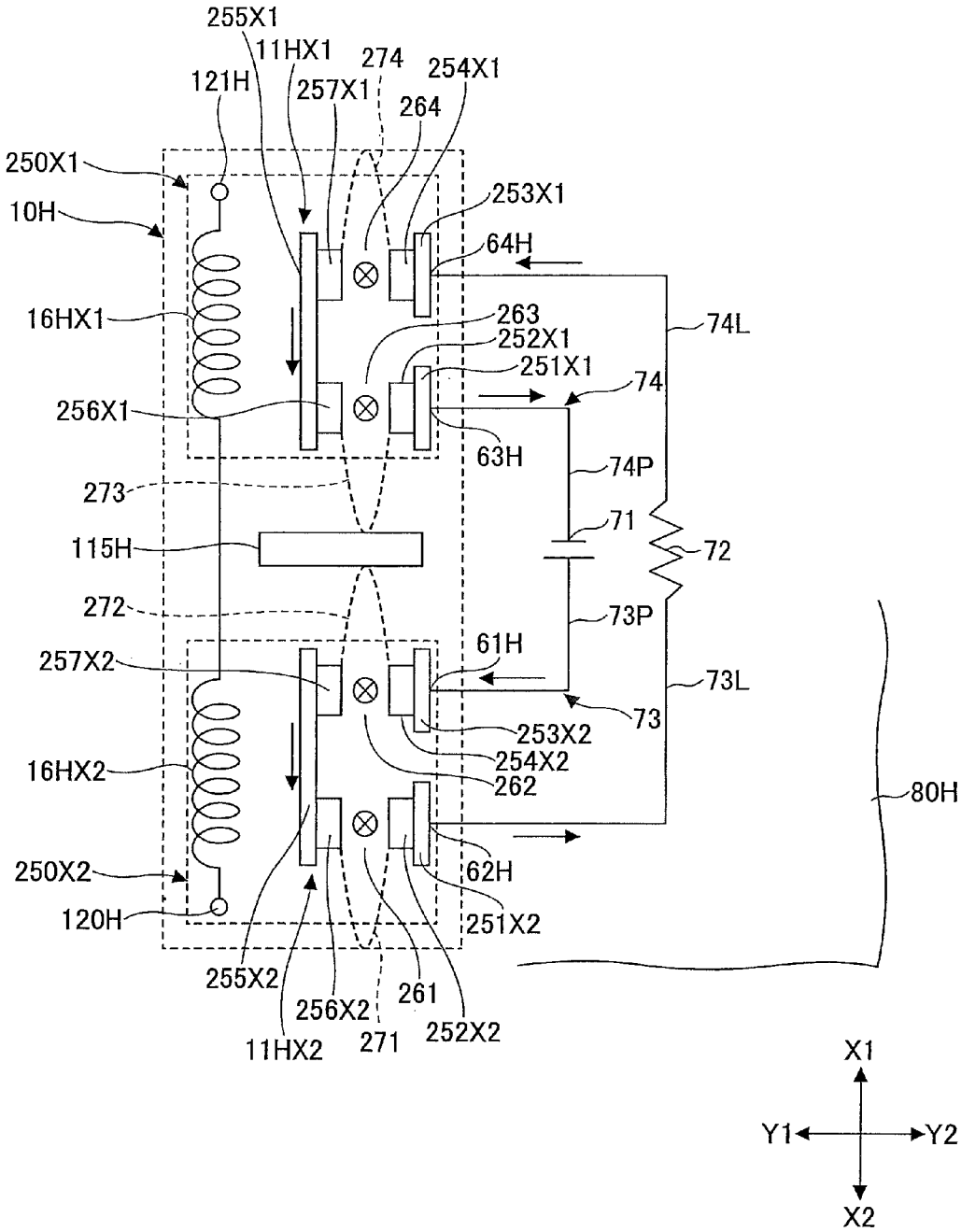
FIG. 19 is a schematic diagram showing the relay and its connection to a direct-current power supply and a load circuit according to the seventh embodiment of the present invention.

FIG. 19 is a schematic diagram showing the relay 10H and its connection to the direct-current power supply 71 and the load circuit 72.

[Configuration of Relay 10H]

The relay 10H includes a first relay main body 250X2 and a second relay main body 250X1 incorporated and arranged side by side on the X2 side and the X1 side, respectively, in the X1-X2 directions in the case 110H.

Referring to FIG. 17, FIGS. 18A through 18C, and FIG. 19, the first relay main body 250X2 includes a first opening and closing part 11HX2 on a base 100HX2 on its Y2 side; a yoke 102HX2 provided in a vertical (standing) position in the center of the base 100HX2; an armature 103HX2 and a card 104HX2 provided in the center of the base 100HX2; a magnetizing coil unit 105HX2 mounted on and fixed to the base 100HX2 on its Y1 side; and terminals 61H and 62H and a terminal 120H projecting from the lower surface of the base 100HX2. The first opening and closing part 11HX2 includes a first gap having a first gap part 261 and a second gap part 262.

The first opening and closing part 11HX2 includes first and second fixed spring terminals 251X2 and 253X2 arranged in the X1-X2 directions and a movable spring member 255X2 large enough to cover the first and second fixed spring terminals 251X2 and 253HX2. Fixed contacts 252X2 and 254X2 are fixed to the first and second fixed spring terminals 251X2 and 253X2, respectively. The lower end of the movable spring member 255X2 is fixed to the base 100HX2 in a bendable manner. Movable contacts 256X2 and 257X2 are fixed to the movable spring member 255X2.

The fixed contact 252X2 and the movable contact 256X2 face each other across the first gap part 261 formed therebetween. The fixed contact 254X2 and the movable contact 257X2 face each other across the second gap part 262 formed therebetween.

The second relay main body 250X1 has the same configuration as the above-described relay main body 250X2, and includes a second opening and closing part 11HX1. The second opening and closing part 11HX1 includes a second gap having a third gap part 263 and a fourth gap part 264.

The second opening and closing part 11HX1 has the third gap part 263 between a fixed contact 252X1 and a movable contact 256X1 and has the fourth gap part 264 between a fixed contact 254X1 and a movable contact 257X1. Terminals 63H and 64H and a terminal 121H are projecting from the lower surface of a base 100HX2.

In the second relay main body 250X1, the same elements as those of the first relay main body 250X2 are referred to by the same reference numerals with a suffix of "X1" instead of "X2" in FIGS. 17 through 19.

A magnetizing coil 16HX2 of a magnetizing coil unit 105HX2 of the first relay main body 250X2 and a magnetizing coil 16HX1 of a magnetizing coil unit 105HX1 of the second relay main body 250X1 are connected in series.

The first and second permanent magnet pieces 30H and 40H each having a rectangular parallelepiped shape are fixed to a top plate part 111H of the case 110H. The first permanent magnet piece 30H is positioned on the Z1 side of the first gap part 261 and the second gap part 262 so as to extend over the first and second gap parts 261 and 262. The second permanent magnet piece 40H is positioned on the Z1 side of the third gap part 263 and the fourth gap part 264 so as to extend over the third and fourth gap parts 263 and 264.

Each of the first and second permanent magnet pieces 30H and 40H is oriented with its north pole on the Z2 side and its south pole on the Z1 side. Magnetic fields of the same orientation act on the first through fourth gap parts 261 through 264 as shown in FIG. 19.

Referring to FIG. 18C, letter indications are provided on the lower surface of each of the bases 100HX1 and 100HX2. It is specified that the terminal 61H is to be connected to the positive terminal of a power supply. It is specified that the terminal 63H is to be connected to the negative terminal of the power supply. It is specified that the terminal 62H is to be connected to one end of a load circuit. It is specified that the terminal 64H is to be connected to the other end of the load circuit.

Referring to FIG. 18B, the case 110H includes a partition plate part 115H in its center. The partition plate part 115H is formed of, for example, a ceramic material, which is resistant to heat. The partition plate part 115H is positioned between the first relay main body 250X2 and the second relay main body 250X1 so as to separate the first and second relay main bodies 250X2 and 250X1.

[Mounting and Operations of Relay 10H]

Referring to FIG. 19, the electric circuit 70 to which the relay 10H is applied includes the direct-current power supply 71 that outputs a voltage as high as several hundred volts, the load circuit 72, the first circuit interconnection 73 that connects the positive terminal of the direct-current power supply 71 and the load circuit 72, and the second circuit interconnection 74 that connects the negative terminal of the direct-current power supply 71 and the load circuit 72. The first circuit interconnection 73 and the second circuit interconnection 74 are formed on one side of a printed circuit board 80H as patterns.

The first circuit interconnection 73 includes the pattern 73P extending from the positive terminal of the direct-current power supply 71 and the pattern 73L extending from one end of the load circuit 72. The second circuit interconnection 74 includes the pattern 74P extending from the negative terminal of the direct-current power supply 71 and the pattern 74L extending from the other end of the load circuit 72.

The relay 10H configured as described above is mounted on the printed circuit board 80H with the terminal 61H inserted into and soldered to a through hole at the end of the pattern 73P, the terminal 63H inserted into and soldered to a through hole at the end of the pattern 74P, the terminal 62H inserted into and soldered to a through hole at the end of the pattern 73L, and the terminal 64H inserted into and soldered to a through hole at the end of the pattern 74L. That is, the first relay main body 250X2 is provided in the middle of the first circuit interconnection 73, and the second relay main body 250X1 is provided in the middle of the second circuit interconnection 74. The terminals 120H and 121H are also inserted into and soldered to corresponding through holes formed in the printed circuit board 80H.

When a direct current flows through the magnetizing coils 16HX2 and 16HX1 through the terminals 120H and 121H, the magnetizing coil units 105HX2 and 105HX1 are simultaneously excited. As a result, in the first relay main body 250X2, the horizontal part of the armature 103HX2 is attracted and adhered to the magnetizing coil unit 105HX2. As a result of this operation of the armature 103HX2, the movable spring member 255X2 is pressed in the Y2 direction, so that the movable contacts 256X2 and 257X2 come into contact with the fixed contacts 252X2 and 254X2, respectively. Thereby, the first relay main body 250X2 is closed. In the second relay main body 250X1, the horizontal part of the armature 103HX1 is attracted and adhered to the magnetizing coil unit 105HX1. As a result of this operation of the armature 103HX1, the movable spring member 255X1 is pressed in the Y2 direction, so that the movable contacts 256X1 and 257X1 come into contact with the fixed contacts 252X1 and 254X1, respectively. Thereby, the second relay main body 250X1 is closed.

As a result, current flows as indicated by arrows in FIG. 19, so that the load circuit 72 operates. In the movable spring member 255X2, current flows from the movable contact 257X2 side to the movable contact 256X2 side. In the movable spring member 255X1, current flows from the movable contact 257X1 side to the movable contact 256X1 side.

When energization of the magnetizing coils 16HX2 and 16HX1 is stopped, the movable contacts 256X2 and 257X2 move out of contact with the fixed contacts 252X2 and 254X2, respectively, and at the same time, the movable contacts 256X1 and 257X1 move out of contact with the fixed contacts 252X1 and 254X1, respectively, so that an arc is generated in each of the first, second, third, and fourth gap parts 261, 262, 263, and 264.

Here, the arc in the first gap part 261 is deflected in the X2 direction and blown off toward a side plate part 112H of the case 110H as indicated by reference numeral 271 to be immediately extinguished, and the arc in the second gap part 262 is deflected in the X1 direction and blown off toward the partition plate part 115H of the case 110H as indicated by reference numeral 272 to be immediately extinguished. The arc in the third gap part 263 is deflected in the X2 direction and blown off toward the partition plate part 115H of the case 110H as indicated by reference numeral 273 to be immediately extinguished, and the arc in the fourth gap part 264 is deflected in the X1 direction and blown off toward a side plate part 113H of the case 110H as indicated by reference numeral 274 to be immediately extinguished.

Figure 20A:
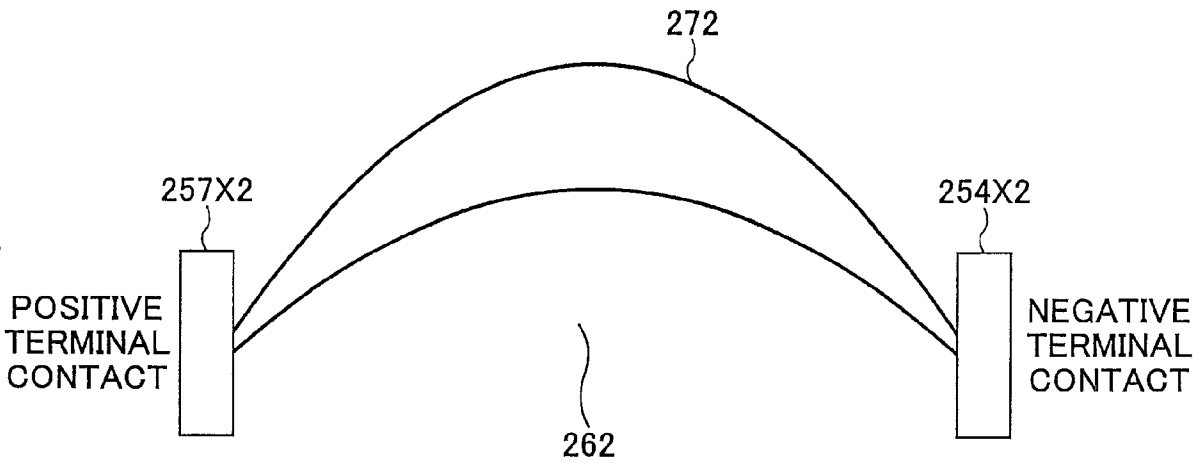
FIG. 20A is a diagram showing an arc generated in a gap and FIG. 20B is a graph showing the configuration of arc voltage according to the seventh embodiment of the present invention.
Figure 20B:
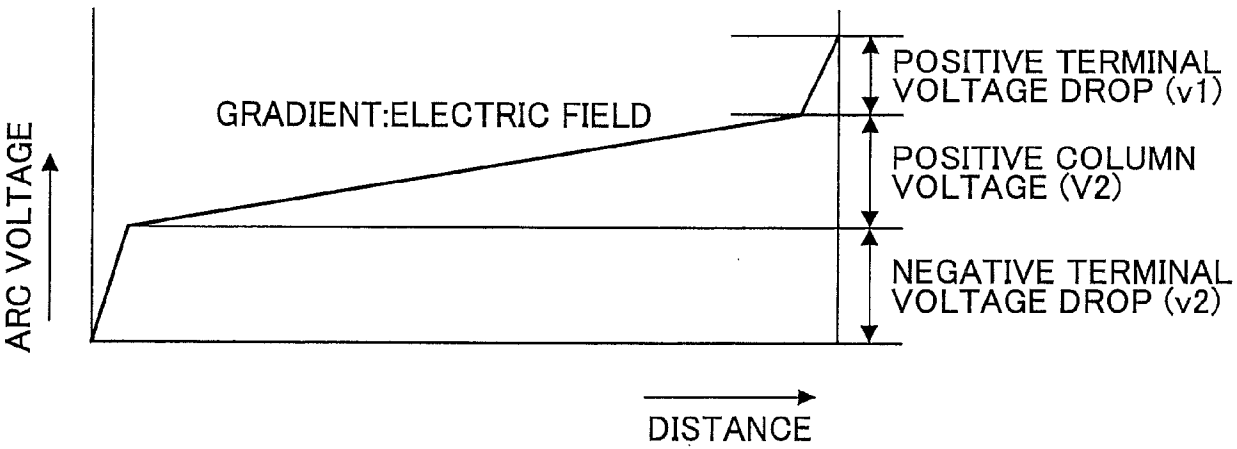

FIG. 20A is a diagram showing an arc 272 generated in the second gap part 262 between the movable contact 257X2, which is a positive terminal, and the fixed contact 254X2, which is a negative terminal. FIG. 20B is a graph showing the configuration of the voltage Varc (a voltage that can sustain an arc) of the arc 272.

The voltage Varc of the arc 272 is the sum of two voltages V1 and V2 as given by the following equation:

$$V\text{arc}=V1+V2,$$

where V1 is the sum of a positive terminal voltage drop v1 generated near the movable contact 257X2 and a negative terminal voltage drop v2 generated near the fixed contact 254X2 (V1=v1+v2), and V2 is arc column voltage (the product of the field intensity of an arc column and its length).

Here, it is necessary for the arc voltage Varc to be greater than the voltage E of the direct-current power supply 71, that is, Varc>E is a necessary condition, in order to prevent an arc from occurring between the movable contact 257X2 and the fixed contact 254X2 when the movable contact 257X2 in contact with the fixed contact 254X2 moves out of contact with the fixed contact 254X2, that is, in order to interrupt current between the movable contact 257X2 and the fixed contact 254X2.

The relay 10H of this embodiment has the two gap parts 262 and 261 connected in series in the first circuit interconnection 73 connecting the positive terminal of the direct-current power supply 71 and the load circuit 72. Accordingly, compared with the case of having a single gap part in the first circuit interconnection 73 as in the case of, for example, using the relay 10A shown in FIG. 4 (first embodiment), the voltage drop V1 is doubled, so that the arc voltage Varc is higher to make an arc less likely to be generated.

The two gap parts 263 and 264 are also connected in series in the second circuit interconnection 74 connecting the negative terminal of the direct-current power supply 71 and the load circuit 72. Accordingly, the arc voltage Varc is higher to make an arc less likely to be generated the same as described above.

Accordingly, when the relay 10H is mounted as shown in FIG. 19, arcs are less likely to be generated in the first through fourth gap parts 261 through 264 and the arcs generated in the first through fourth gap parts 261 through 264 are blown off and immediately extinguished as described above, so that the movable contacts 256X2, 257X2, 256X1, and 257X1 and the fixed contacts 252X2, 254X2, 252X1, and 254X1 are prevented from being damaged. As a result, there is no degradation of the performance of the relay 10H even after multiple opening and closing operations, so that the relay 10H enjoys a long useful service life.

Further, while the number of gaps (261 through 264) of the relay 10H is four the same as in the relay 10E shown in FIG. 13 and the relay 10F shown in FIG. 14, the number of terminals (for the electric circuit 70) projecting from the bottom of the relay 10H may be four, which is half the number of terminals (eight) of the relay 10E or the relay 10F. (See FIG. 18C.) As a result, according to the relay 10H, the number of relay-related patterns of the printed circuit board may be reduced, and the patterns may be formed on only one side of the printed circuit board without using both sides of the printed circuit board, so that the manufacturing cost of the printed circuit board may be reduced.

Further, the partition plate part 115H may be omitted if the first relay main body 250X2 and the second relay main body 250X1 may be spaced at a sufficient distance from each other. In the case of omitting the partition plate part 115H, the first and second permanent magnet pieces 30H and 40H may be integrated, that is, may be replaced with a single long, narrow permanent magnet piece.

Further, the partition plate part 115H may be a member separate from the case 110H.

Eighth Embodiment

Figure 21:
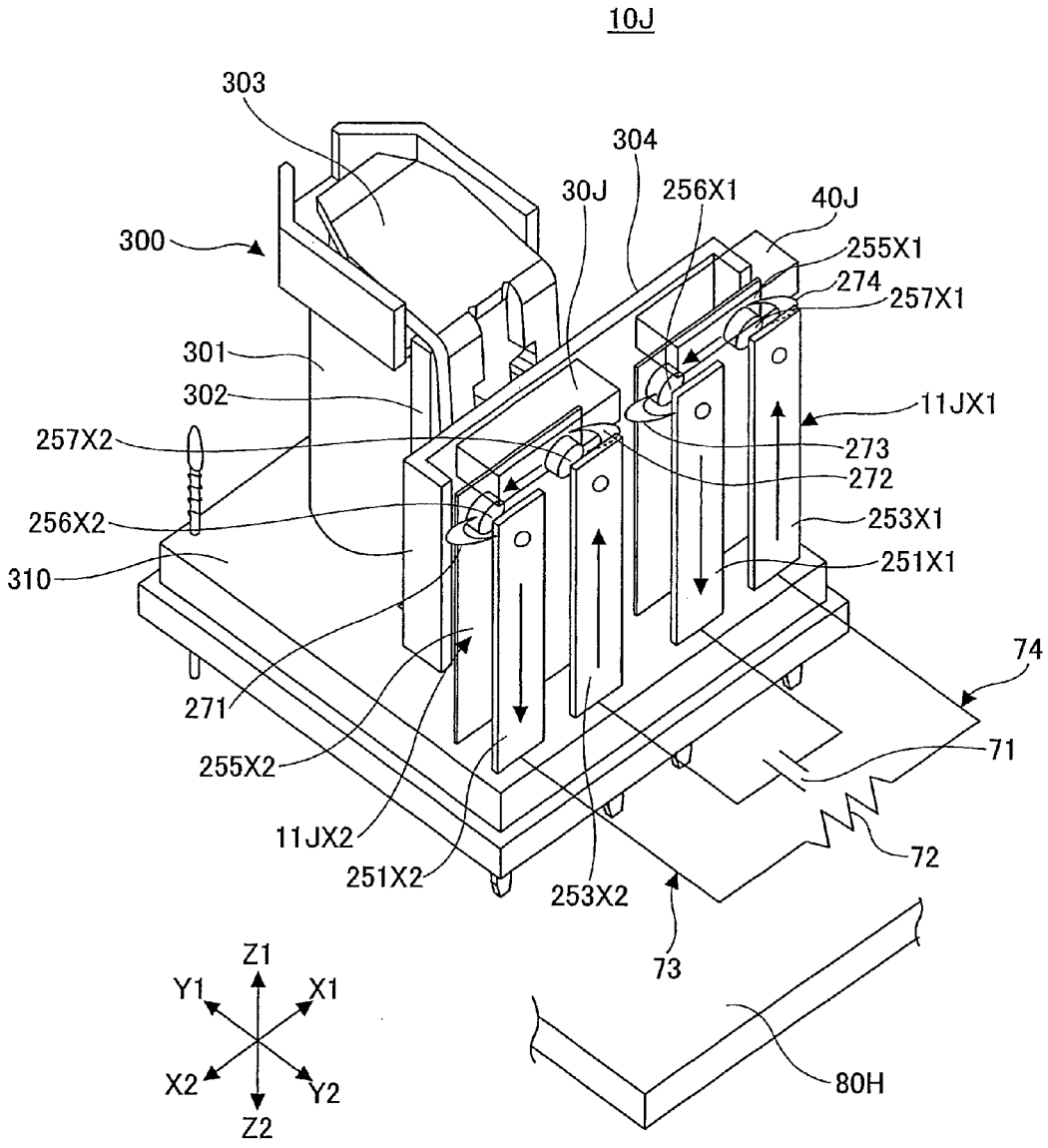
FIG. 21 is a perspective view of a relay without a case, where permanent magnet pieces are shown as transparent, according to an eighth embodiment of the present invention.

FIG. 21 is a perspective view of a relay 10J without a case according to an eighth embodiment of the present invention. In FIG. 21, first and second permanent magnet pieces 30J and 40J are shown as transparent for convenience of description.

The relay 10J is different from the relay 10H shown in FIG. 17 (seventh embodiment) in that the first relay main body 250X2 and the second relay main body 250X1 are integrated and the magnetizing coil units 105HX2 and 150HX1 are replaced with a single magnetization driving part 300.

The magnetization driving part 300 includes a magnetizing coil unit 301, a yoke 302, an armature 303, and a card 304. The card 304 extends over the movable spring member 255X2 and the movable spring member 255X1.

A first opening and closing part 11JX2 and a second opening and closing part 11JX1 are arranged in the X1-X2 directions on a single base 310.

When the single magnetization driving part 300 is driven, the movable spring members 255X2 and 255X1 are pressed in the Y2 direction through the card 304, so that the first opening and closing part 11JX2 and the second opening and closing part 11JX1 are simultaneously closed.

Ninth Embodiment

Figure 22:
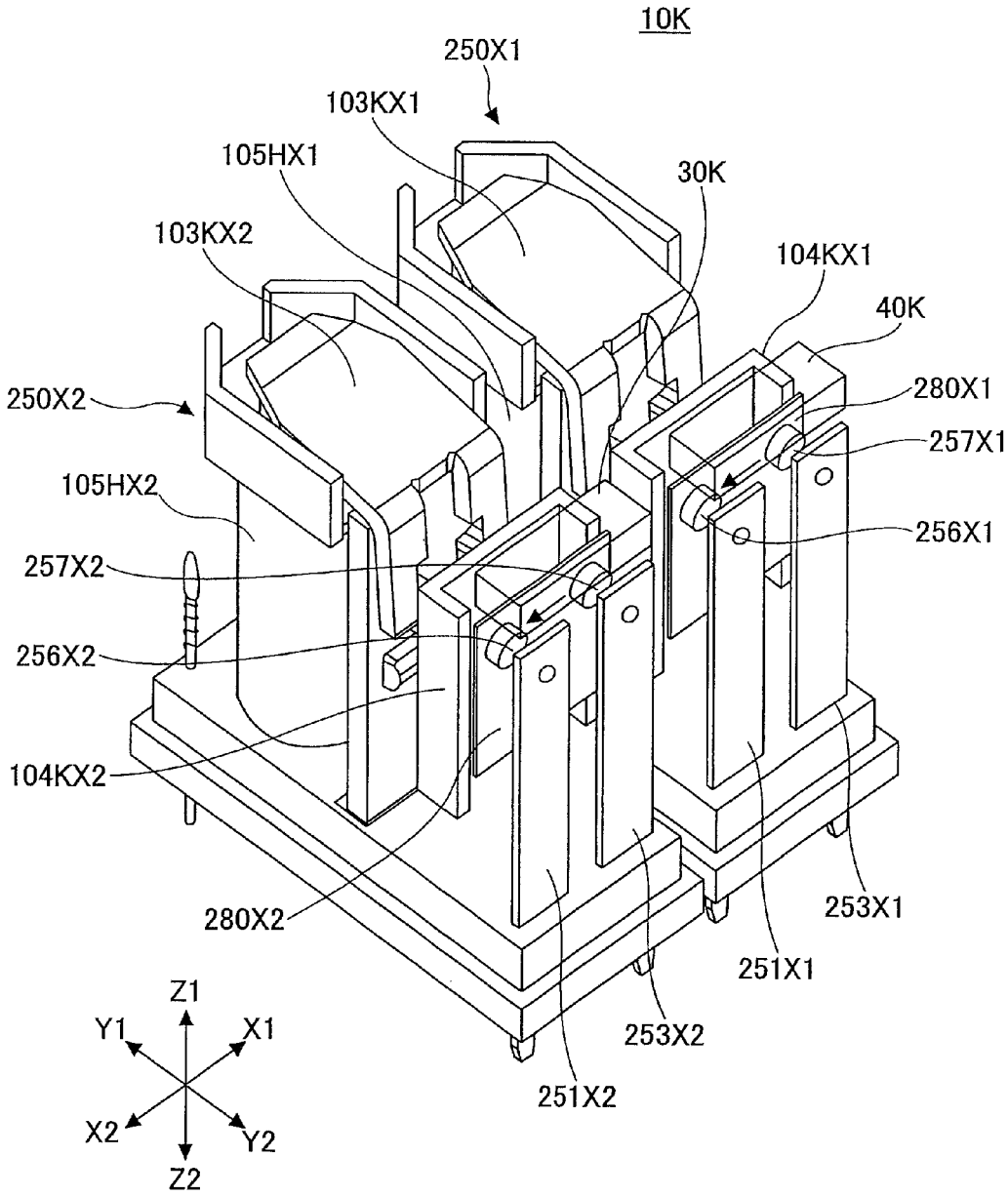
FIG. 22 is a perspective view of a relay without a case, where permanent magnet pieces are shown as transparent, according to a ninth embodiment of the present invention.

FIG. 22 is a perspective view of a relay 10K without a case according to a ninth embodiment of the present invention. In FIG. 22, first and second permanent magnet pieces 30K and 40K are shown as transparent for convenience of description.

The relay 10K is different from the relay 10H shown in FIG. 17 (seventh embodiment) in that the movable spring members 255X2 and 255X1 of FIG. 17 are replaced with movable spring members 280X2 and 280X1, respectively.

The movable spring member 280X2 is large enough to extend over the first and second fixed spring terminals 251X2 and 253X2, and has the movable contacts 256X2 and 257X2 fixed thereto. The movable spring member 280X2 is fixed to the Y2-side surface of a card 104KX2. The card 104KX2 is fixed to the vertical part of an L-shaped armature 103KX2.

The movable spring member 280X1 is large enough to extend over the third and fourth fixed spring terminals 251X1 and 253X1, and has the movable contacts 256X1 and 257X1 fixed thereto. The movable spring member 280X1 is fixed to the Y2-side surface of a card 104KX1. The card 104KX1 is fixed to the vertical part of an L-shaped armature 103KX1.

When the first relay main body 250X2 and the second relay main body 250X1 are simultaneously driven, the cards 104KX2 and 104KX1 are simultaneously driven in the Y2 direction, so that the movable spring members 280X2 and 280X1 are simultaneously displaced in the Y2 direction.

The magnetizing coil units 105HX2 and 105HX1 of the relay 10K may be replaced with a single magnetizing coil unit as in the above-described relay 10J of the eighth embodiment (FIG. 21). According to this configuration, the single magnetizing coil unit is driven to displace the movable spring members 280X2 and 280X1.

Tenth Embodiment

Figure 23:
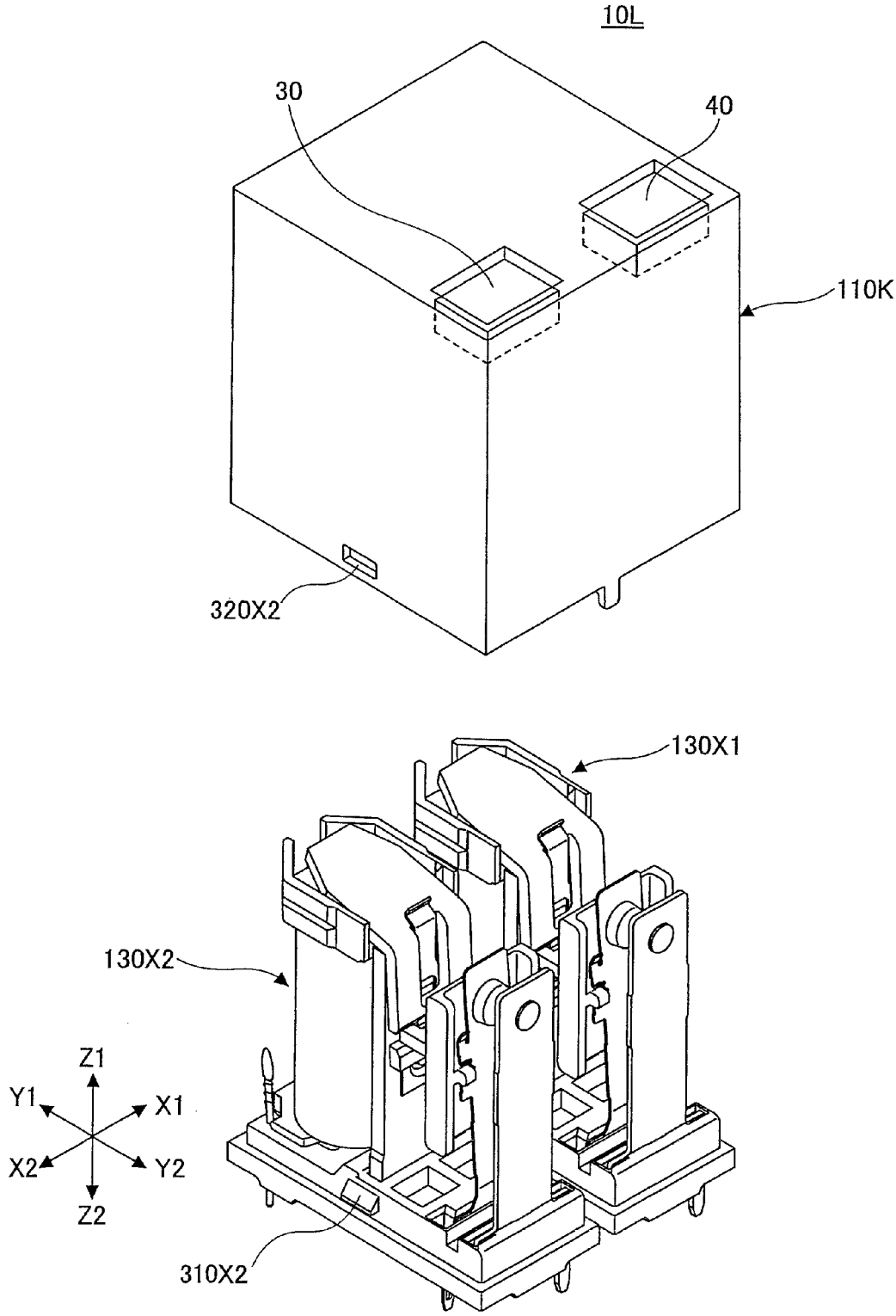
FIG. 23 is an exploded perspective view of a relay according to a tenth embodiment of the present invention.

FIG. 23 is an exploded perspective view of a relay 10L according to a ninth embodiment of the present invention.

Figure 24:
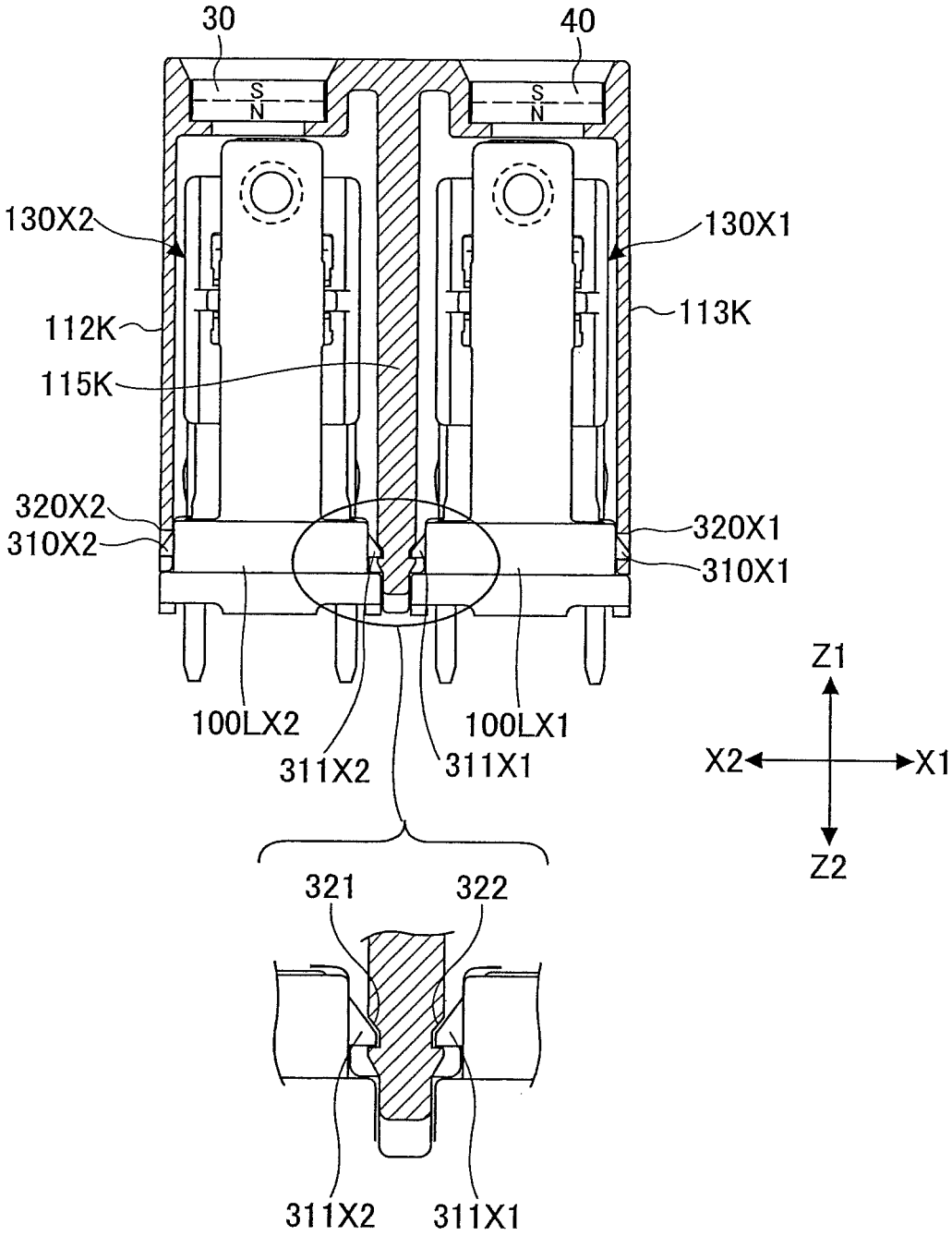
FIG. 24 is a Y2-side cut-away view of the relay according to the tenth embodiment of the present invention.

FIG. 24 is a Y2-side cut-away view of the relay 10L of FIG. 23.

The relay 10L is different in case fixation structure from the relay 10B shown in FIGS. 8A through 8C (second embodiment).

A case 110K includes side plate parts 112K and 113K and a center partition wall part (insulation barrier) 115K. The case 110K is joined to the relay main bodies 130X1 and 130X2 with a hole 320X2 formed in a portion of the side plate part 112K near its lower end engaging a latch claw part 310X2 of a base 100LX2 of the relay main body 130X2, a hole 320X1 formed in a portion of the side plate part 113K near its lower end engaging a latch claw part 310X1 of a base 100LX1 of the relay main body 130X1, an X2-side recess 321 formed in a portion of the partition wall part 115K near its lower end engaging a latch claw part 311X2 of the base 100LX2 of the relay main body 130X2, and an X1-side recess 322 formed in a portion of the partition wall part 115K near its lower end engaging a latch claw part 311X1 of the base 100LX1 of the relay main body 130X1. Thus, the joining strength of the case 110K and the relay main bodies 130X1 and 130X2 is high. The partition wall part 115K has the function of fixing the relay main bodies 130X1 and 130X2.

According to one aspect of the present invention, a permanent magnet is provided so as to apply magnetic fields of the same orientation on the gap of a first opening and closing part (first gap) and the gap of a second opening and closing part (second gap). Therefore, it is possible to simultaneously break both of a first circuit interconnection connecting the positive terminal of a direct-current power supply and a load and a second circuit interconnection connecting the negative terminal of the direct-current power supply and the load with a single relay by providing the first opening and closing part in the middle of the first circuit interconnection and providing the second opening and closing part in the middle of the second circuit interconnection.

Further, since the arcs generated in the first gap and the second gap are both blown off outward and extinguished, it is possible to prevent the first opening and closing part and the second opening and closing part from being damaged. As a result, there is no degradation of the performance of the relay even after multiple opening and closing operations, so that the relay enjoys a long useful service life.

Further, there is no need to cross circuit interconnections formed on a printed circuit board on which the relay is mounted. Accordingly, it is possible to form circuit connections using only one side of the printed circuit board.

The present invention is not limited to the specifically disclosed embodiments, and variations and modifications may be made without departing from the scope of the present invention.

The present application is based on Japanese Priority Patent Applications No. 2007-239233, filed on Sep. 14, 2007, and No. 2008-089410, filed on Mar. 31, 2008, the entire contents of which are hereby incorporated by reference.

What is claimed is:

1. A relay, comprising:

a first relay main body including a first opening and closing part and a first magnetization driving part configured to cause the first opening and closing part to operate, the first opening and closing part including a first movable contact and a first fixed contact facing each other across a first gap so as to be movable into and out of contact with each other, a first movable terminal having the first movable contact, and a first fixed spring terminal having the first fixed contact;

a second relay main body including a second opening and closing part and a second magnetization driving part configured to cause the second opening and closing part to operate, the second opening and closing part including a second movable contact and a second fixed contact facing each other across a second gap so as to be movable into and out of contact with each other, a second movable terminal having the second movable contact, and a second fixed terminal having the second fixed contact;

a case that includes a first side plate part, a second side plate part facing toward the first side plate part, and a top plate part and covers the first relay main body and the second relay main body; and a first permanent magnet and a second permanent magnet fixed to the top plate part of the case so as to face the first gap and the second gap, respectively, the first permanent magnet and the second permanent magnet being oriented so as to have a same magnetic pole facing toward the first and second gaps, wherein the first permanent magnet and the second permanent magnet apply magnetic fields on the first gap and the second gap, respectively, to blow off a first arc generated in the first gap and a second arc generated in the second gap in opposite directions toward the first side plate part and the second side plate part, respectively.

2. The relay as claimed in claim 1, wherein:

the case has a partition plate part provided therein, the first relay main body and the second relay main body include a first base and a second base, respectively, and the partition plate part engages the first base and the second base.

3. The relay as claimed in claim 1, wherein each of the first and second permanent magnets is one of a samarium-cobalt magnet, a neodymium magnet, and a ferrite magnet.

4. The relay as claimed in claim 1, wherein the case has a heat-resisting structure.

5. A circuit device, comprising:

a first circuit interconnection connecting a positive terminal of a direct-current power supply and a load;

a second circuit interconnection connecting a negative terminal of the direct-current power supply and the load; and the relay as set forth in claim 1, wherein the relay is provided so that the first opening and closing part makes and breaks the first circuit interconnection and the second opening and closing part makes and breaks the second circuit interconnection.

* * * * *